US007422118B2

(12) United States Patent
Ugo et al.

(10) Patent No.: US 7,422,118 B2
(45) Date of Patent: Sep. 9, 2008

(54) EQUIPMENT FOR THE AUTOMATIC DEPOSIT OF BANKNOTES

(75) Inventors: Franco Ugo, Bollengo (IT); Guido Genisio, Cuorgné (IT); Stefano Maglione, Cossano (IT); Paolo Ciampi, Salerano Canavese (IT)

(73) Assignee: CTS Cashpro, S.p.A., Bollengo (Turin) (IT)

( * ) Notice: Subject to any disclaimer, the term of this patent is extended or adjusted under 35 U.S.C. 154(b) by 490 days.

(21) Appl. No.: 11/011,606

(22) Filed: Dec. 15, 2004

(65) Prior Publication Data

US 2005/0127590 A1 Jun. 16, 2005

(51) Int. Cl.
*B07C 5/00* (2006.01)
*G07F 7/04* (2006.01)
*B65H 39/10* (2006.01)

(52) U.S. Cl. ..... 209/534; 194/206; 271/294; 271/298; 271/9.08; 902/17

(58) Field of Classification Search ..... 209/534; 194/206, 207; 902/9, 11–15, 17; 198/418.4, 198/369.1, 370.06, 435; 271/262, 265.04, 271/3.01, 3.14, 9.08, 298, 292, 294; 273/149 R, 273/149 P
See application file for complete search history.

(56) References Cited

U.S. PATENT DOCUMENTS 4,050,562 A 9/1977 Schwippert et al.
4,465,925 A 8/1984 Goi
4,884,698 A * 12/1989 Tutamune et al. ..... 209/534
5,499,805 A * 3/1996 Anma ..... 271/3.05
5,673,333 A * 9/1997 Johnston ..... 382/137
6,024,531 A * 2/2000 Schulze ..... 414/790.2
6,607,081 B2 * 8/2003 Graef et al. ..... 209/534
6,749,053 B2 * 6/2004 Ikuta ..... 194/206

(Continued)

FOREIGN PATENT DOCUMENTS

JP 11278665 A 10/1999

OTHER PUBLICATIONS

European Search Report dated Nov. 21, 2005 in Application No. EP 04 02 9436.

*Primary Examiner*—Patrick Mackey
*Assistant Examiner*—Mark Hageman
(74) *Attorney, Agent, or Firm*—Banner & Witcoff, Ltd

(57) ABSTRACT

An equipment (22) for the automatic deposit of banknotes (23) comprising a transaction port (33) for receiving a stack (24) of banknotes, a separating device (36) for separating the constituting sheets of the stack (24), a validation device (37) for discriminating the constituting sheets as recognized banknotes and constituting sheets not recognized, a transport mechanism (38, 39) servo-dependent on the validation device to drag said constituting sheets along differentiated paths (72, 73) for the recognized banknotes and the constituting sheets not recognized, and a box assembly (51) adjacent to the transaction port. The box assembly (51) includes two storage boxes (53, 54) and is shiftable among at least three different positions. The three positions are associated with predetermined conditions of communication of the storage boxes (53, 54) with the transaction port (33), the separating device (36) and the transport mechanism (38, 39) to receive the stack, transfer the stack to the separating device, temporarily store as banknote sub-stack and as discard sub-stack the recognized banknotes and, respectively, the constituting sheets not recognized and to return, by request, the discard sub-stack and the banknote sub-stack.

20 Claims, 12 Drawing Sheets

U.S. PATENT DOCUMENTS 6,805,285 B2 * 10/2004 Peebles et al. ..... 235/379
2003/0038173 A1 * 2/2003 Blackson et al. ..... 235/379
2003/0116622 A1 * 6/2003 Suttie et al. ..... 235/379
2004/0182678 A1 * 9/2004 Ina et al. ..... 194/207

* cited by examiner

EQUIPMENT FOR THE AUTOMATIC DEPOSIT OF BANKNOTES

FIELD OF THE INVENTION

The present invention relates to an equipment for the automatic deposit of banknotes. More specifically, the invention relates to an equipment for the automatic deposit of stacked banknotes comprising a transaction port for receiving a stack of banknote and a separating device for separating the constituting sheets of the stack.

BACKGROUND OF THE INVENTION

A typical need of the banking automation relates to the possibility to find an equipment for advantageously replacing the functions of the tellers to allow the banking institute, as management entity, to employ this personnel for more profitable activities and enabling the customers to deposit banknotes, without assistance, 24 hours a day.

A system for the automatic processing of banknotes comprising a device for the deposit and a device for the withdrawal described in PCT Patent Application WO 99/48064 in the name of CTS Cashpro S.r.1. The device for the deposit of the banknotes is located in a protected environment with access allowed to selected customers through authorizing codes, whilst the device for the withdrawal can be used by generalized customers and works in an environment open to the public.

The withdrawal device of the Patent Application WO 99/48064 re-uses a good portion of the banknotes deposited in the deposition device. The system results very advantageous. In fact, the banking institutes can accomplish a continuous recharge of the banknotes to be dispensed, and the customers may obtain an immediate accredit of the deposited amounts. On the other hand, this system results rather expensive and its use is limited to special cases.

SUMMARY OF THE INVENTION

A main object of the present invention is to provide an equipment for the automatic deposit of banknotes of relatively limited cost and which can be used with full satisfaction by the management entities and, in a reliable way, by generalized customers and in premises normally open to the public.

Another object of the invention is to provide an equipment for the automatic deposit of stacked banknotes allowing the handling of relatively high thickness and the return of the stack, in the case of a contrary decision of the customer.

According to a first feature, the equipment for the automatic deposit of banknotes comprises a transaction port for receiving a stack of banknotes, a separating device for separating the constituting sheets of the stack, a validation device for discriminating the constituting sheets as recognized banknotes and constituting sheets not recognized, a transport mechanism servo-dependent on the validation device to drag said constituting sheets along differentiated paths for the recognized banknotes and, respectively, for the constituting sheets not recognized, and a box assembly adjacent to said transaction port, wherein said assembly includes two storage boxes and is shiftable among at least three different positions; and wherein said positions are associated with predetermined conditions of communication of the storage boxes with the transaction port, the separating device and the transport mechanism to receive the stack, transfer the stack to the separating device, temporarily store as banknote sub-stack and as discard sub-stack the recognized banknotes and, respectively, the constituting sheets not recognized and to return, by request, the discard sub-stack and the banknote sub-stack.

The equipment for the automatic deposit of banknotes can comprise a transaction port for receiving stacked banknotes, a window of access toward the inside, a shutter door for said window movable along a movement surface adjacent to the window, and a moving mechanism for the automatic insertion of the stack received in the transaction port, said equipment further comprising a thickness control device having a sensing device provided for bearing on a stack of the transaction port to detect a condition of pre-defined maximum thickness of said stack; wherein said moving mechanism is servo-dependent on the sensing device for introducing stacks having a thickness less than said maximum thickness; and wherein the sensing device is operative jointly with the movement of the door.

Another object of the invention is to accomplish an equipment of deposit which can easily be added, with limited costs, to machines for the withdrawal of banknotes in broadly tested and possibly already installed systems, without requiring substantial adjunctive spaces and with limited interventions and maintenance costs.

According to this object, the equipment for the automatic deposit of banknotes comprises a containing structure of substantially parallelepiped shape, vertically extended in use, with front and base of reduced width and having, on the front, said transaction port and, on the base, an output opening of access to a store for the deposited banknotes and for the constituting sheets not recognized, with insertion and shifting of the banknotes in a longitudinal sense; and a plurality of storage boxes for temporarily storing sub-stacks of said constituting sheets; the separating device, the validation device and the storage boxes defining functional groups mounted on an internal side of the containing structure, said functional groups being provided for facilitated removal from said side on maintenance or substitution operations.

A further object of the invention is to provide an equipment for the automatic processing of banknotes which can receive stacks of relatively high thickness and with undiversified denominations, to separate the banknotes and to reform the stacks, for a possible return, after a check at high velocity.

In accomplishing this object, the equipment for the automatic processing of banknotes comprises a banknote box provided for shifting in a space adjacent to the transaction port between a first position adjacent to the transaction port and a second position on the path for the recognized banknotes; a moving mechanism mounted on said banknote box and having upper and lower endless conveyer belts provided for concurrent movements; and a holding mechanism in said banknote box, actuatable to move the upper belts with respect to the lower belts; and wherein the banknote box is predisposed for receiving on the lower conveyer belts the stack in insertion at said first position, and the recognized banknotes, with formation of a banknote sub-stack, at said second position; the holding mechanism defining three configurations including a first configuration, of medium distance between the belts, for receiving the stack from said transaction port, a second configuration for integrally shifting the sheets constituting the stack or the banknote sub-stack by means of the upper belts and the lower belts, and a third configuration, of larger distance between the belts, for the formation of said banknote sub-stack.

The characteristics of the invention will become clear from the description that follows, provided merely by way of non-restrictive example, with the aid of the accompanying drawings, wherein:

DESCRIPTION OF THE PREFERRED EMBODIMENTS

Figure 1:
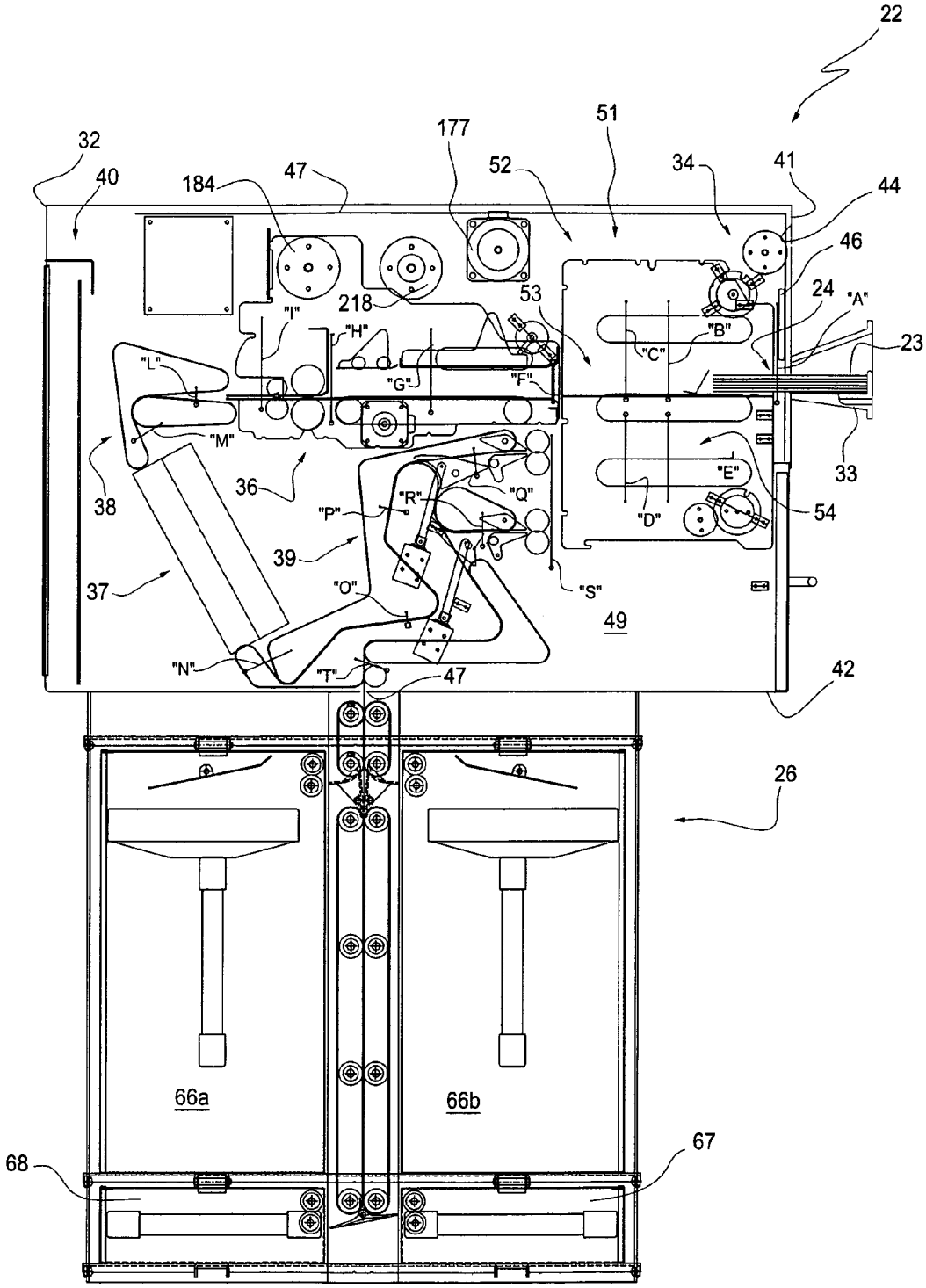
FIG. 1 represents a side schematic view of an equipment for the deposit of banknotes according to the invention.

Represented with 22 with reference to FIG. 1, is an equipment for the automatic deposit of banknotes. The banknotes to be deposited, designated with 23, are piled as sheets of a stack 24 and, after checks, are provided for transfer to a store-safe 26, whereas the respective amounts are accounted and accredited.

In an exemplary application, the deposit equipment 22 can operate in association with a machine 27 (FIG. 2) for the withdrawal of banknotes, including a badge reader 28, a screen 29 and a keyboard 31 and connected to a banking system for on-line transactions. In this case, the reader, the screen and the keyboard of the machine 27 also constitute for the customers the elements of interface with the deposit equipment 22.

The equipment 22 comprises a containing structure 32 with a transaction port 33 to receive the stack 24, and includes a thickness control device 34, a separating device 36, a validation device 37 and a transport mechanism with two sections 38 and 39. An electronic processing unit 40 feeds and controls the electromechanic components and provides the input-output connections with the system for on-line transactions, specifically with the exemplary machine 27.

The thickness control device 34 is provided to check a condition of maximum acceptable thickness of the stack 24 whilst the separating device 36 is provided to separate individually the sheets constituting the stack 24.

The validation device 37 is provided to analyze the nature of the constituting sheets separated by the device 36, recognizing the banknotes acceptable for the deposit and the constituting sheets non-acceptable. The device 37 also recognizes the denominations of the validated banknotes and discriminates, between the non-acceptable constituting sheets, the discards to be manually re-handled and the false banknotes.

In the transport mechanism, the first section 38 is interposed between the separating device 36 and the validation device 37; the second section 39 is downstream of the device 37 and comprises a plurality of branches to guide and drag the analyzed constituting sheets according to differentiated paths.

The containing structure 32 has a substantially parallelepiped shape, with a front 41 and a base 42. The front 41 provides a removable panel 43, on which the transaction port 33 is lodged, whilst the base 42 has an output opening 44 of access to the store-safe 26 (FIG. 1).

On the front 41 are mounted a shutter door 46 for the transaction port 33 and a servomechanism for the door 46, which are used together with other components in the thickness control device 34. In particular, the shutter door 46 constitutes a sensing element for the control device 34.

The containing structure 32 is relatively narrow, vertically extended in use, and can be mounted above the store-safe 26. Further, the widths of the transaction port 33 and the output opening 44 are a few larger of the height, of smaller dimension, of the acceptable banknotes of higher amount, according to an S.E.F. (Short Edge First) insertion of the stacks 24 in the longitudinal sense of the banknotes.

The equipment 22 includes, as a support for the inside components, a frame 47 having a back plate 48 and a side plate 49. The processing unit 40 is mounted on the back plate 48 and is protected by a removable panel. The devices 36 and 37 and the sections 38 and 39 of the transport mechanism are mounted on the side plate 49 and project inside the structure 32 to drag the stack 24 or the single banknotes in the longitudinal sense of the banknotes consistent with the direction of insertion.

With this arrangement, the equipment 22 can be easily installed side by side and without substantial increase of space in the area in which the machine 27 for the withdrawal of banknotes (FIG. 2) is already present. By way of example, the containing structure 32 can be lodged in a seat 56, adjacent to the reader 28, the screen 29 and the keyboard 31. The structure 32 is removable toward the anterior by means of a handle 57, for accessing the inside components in case of jamming for operations of maintenance in general.

The containing structure 32 defines a passage space 51 adjacent to the front 41, whilst the separating device 36 and the section 39 of the transport mechanism take up a central section adjacent to the space 51.

According to the invention, a box assembly 52 is arranged in the passage space 51 with possibility of shifting in vertical. The assembly 52 includes a banknote storage box 53 and a discard storage box 54 to temporarily store the banknotes to be deposited and the other sheets of the stack 24 during the procedure of deposit. In detail, the box 53 is provided to store the stack 24 and the validated banknotes and, respectively, the box 54 can receive the constituting sheets of the separated stack as banknote sub-stack 50 and, respectively, as discard sub-stack 55.

In synthesis, the separating device 36 (FIGS. 2 and 14-16) comprises a stack moving mechanism 58 for shifting the stack 24 or of the sub-stacks 50, 55 and a separating mechanism 59 for separating the sheets constituting the stacks 24 and the sheets constituting the sub-stacks 50 and 55.

In the box assembly 52 (FIGS. 2 and 7-10), the banknote box 53 and the discard box 54 are arranged at different heights, high and low, respectively. The assembly 52 includes a moving mechanism 60 and the storage boxes 53 and 54 include two respective holding mechanisms 61 and 62 to drag the stack 24 in a step of insertion of the procedure of deposit, and to drag the sub-stacks 50 and 55 in association with the temporary store of the sheets constituting the stack 24.

Figure 4:
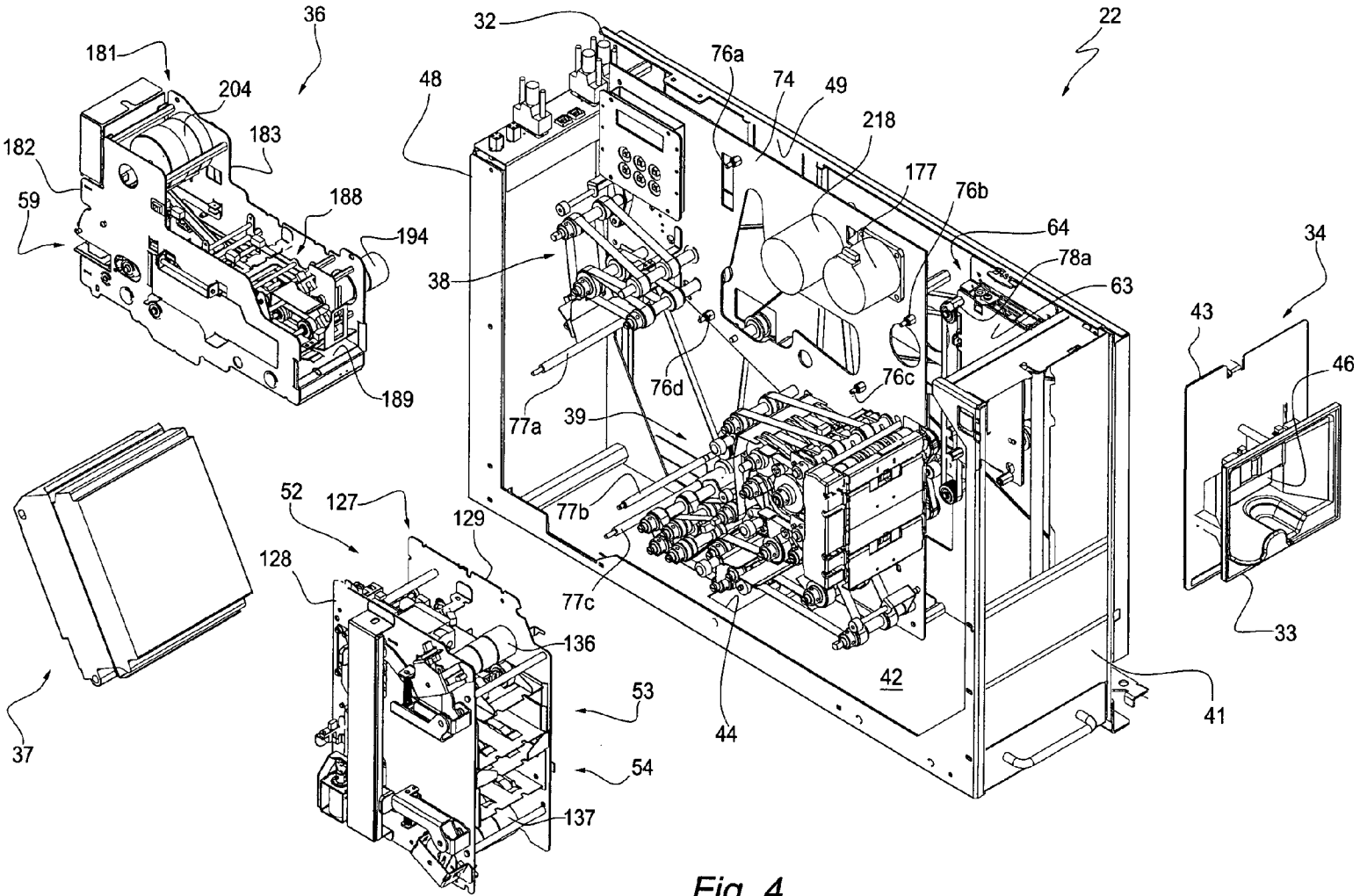
FIG. 4 represents an, exploded, front perspective view of an equipment for the deposit of banknotes according to the invention.
Figure 5:
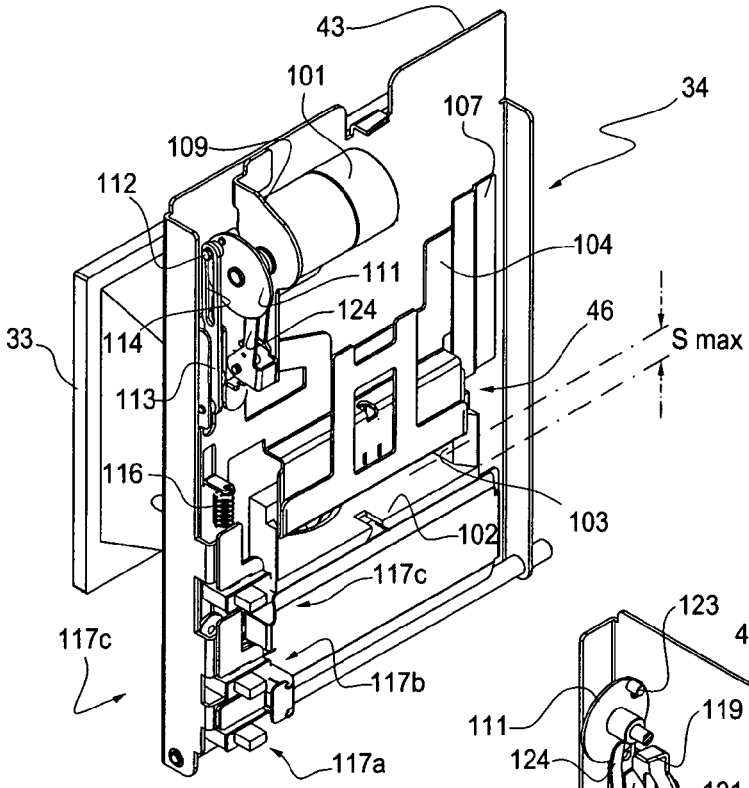
FIG. 5 shows, in enlarged scale, a perspective rear view of a device of the equipment represented in FIG. 4.
Figure 6A:
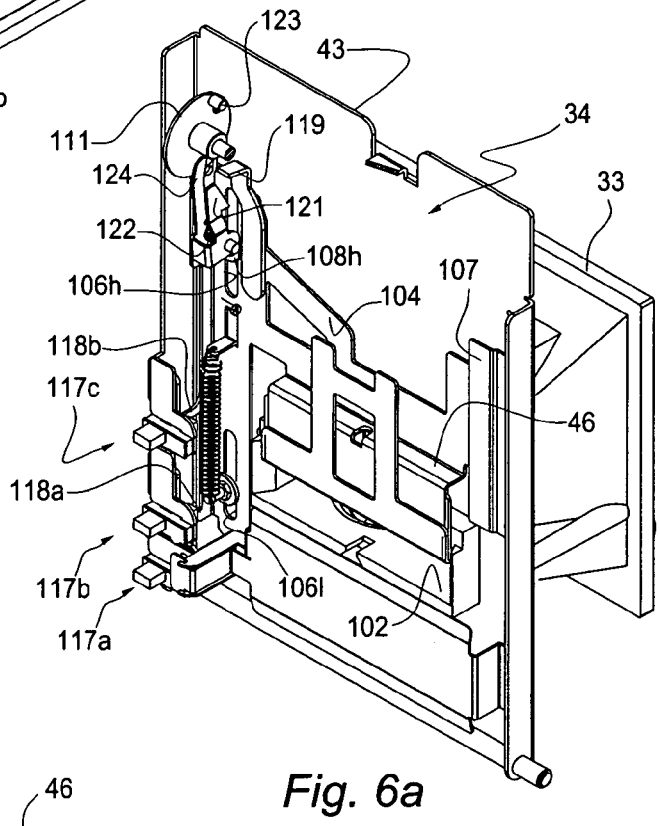
FIGS. 6*a* and 6*b* represent two other perspective views of the device shown in FIG. 5 in different working conditions.
Figure 6B:
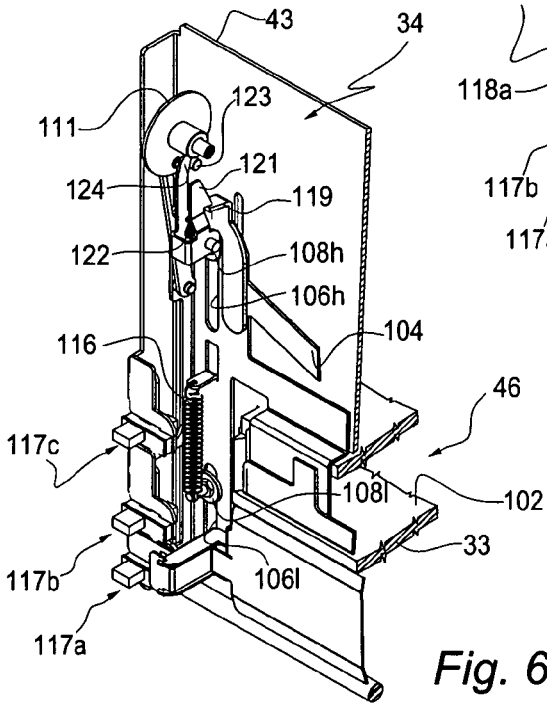
Figure 7:
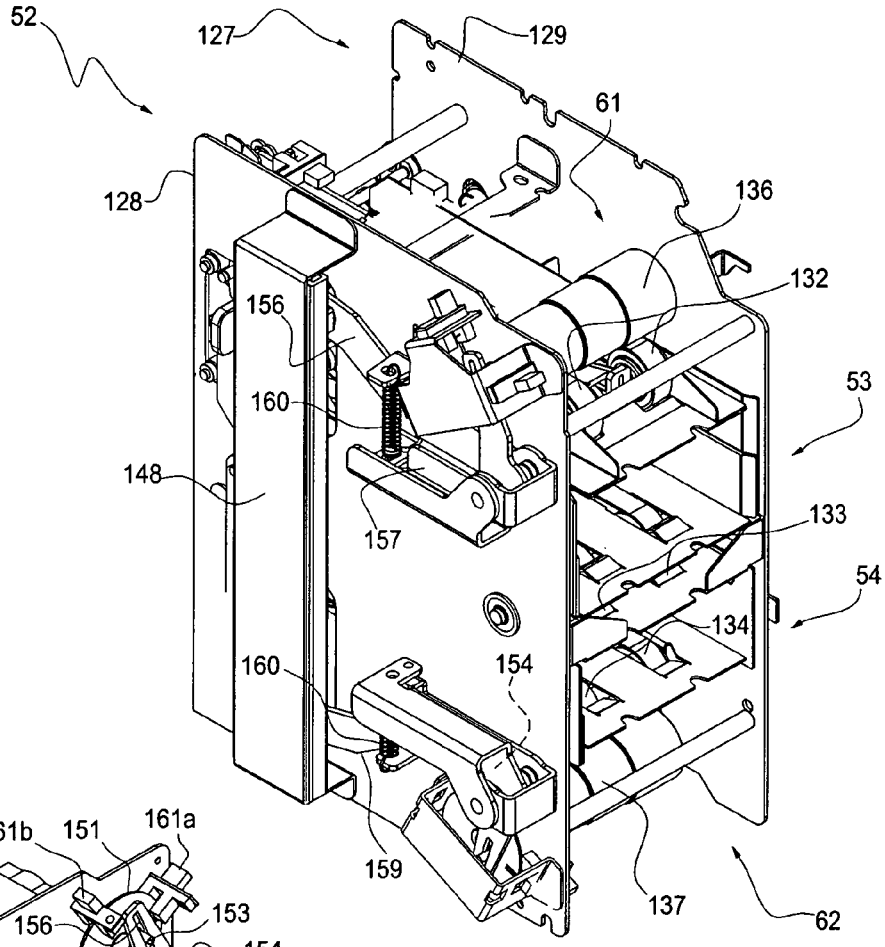
FIG. 7 shows, in enlarged scale, a perspective view of another device of the equipment represented in FIG. 4.
Figure 7A:
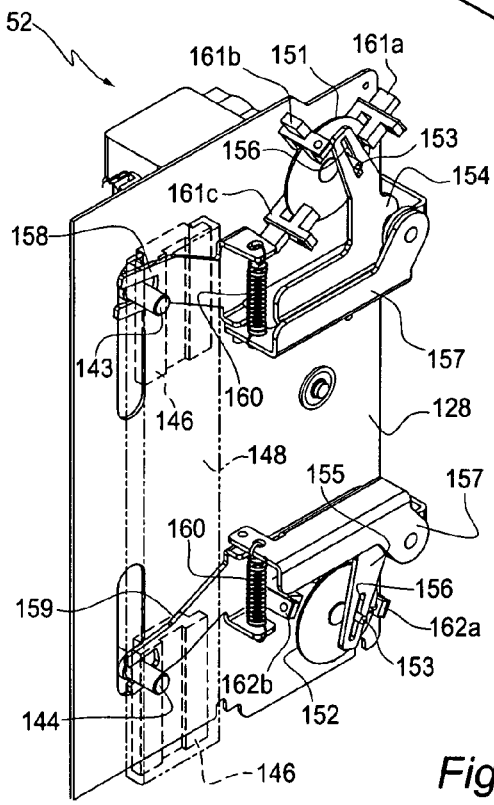
FIG. 7*a* is a partial perspective view showing rear details of the device of FIG. 7.
Figure 8:
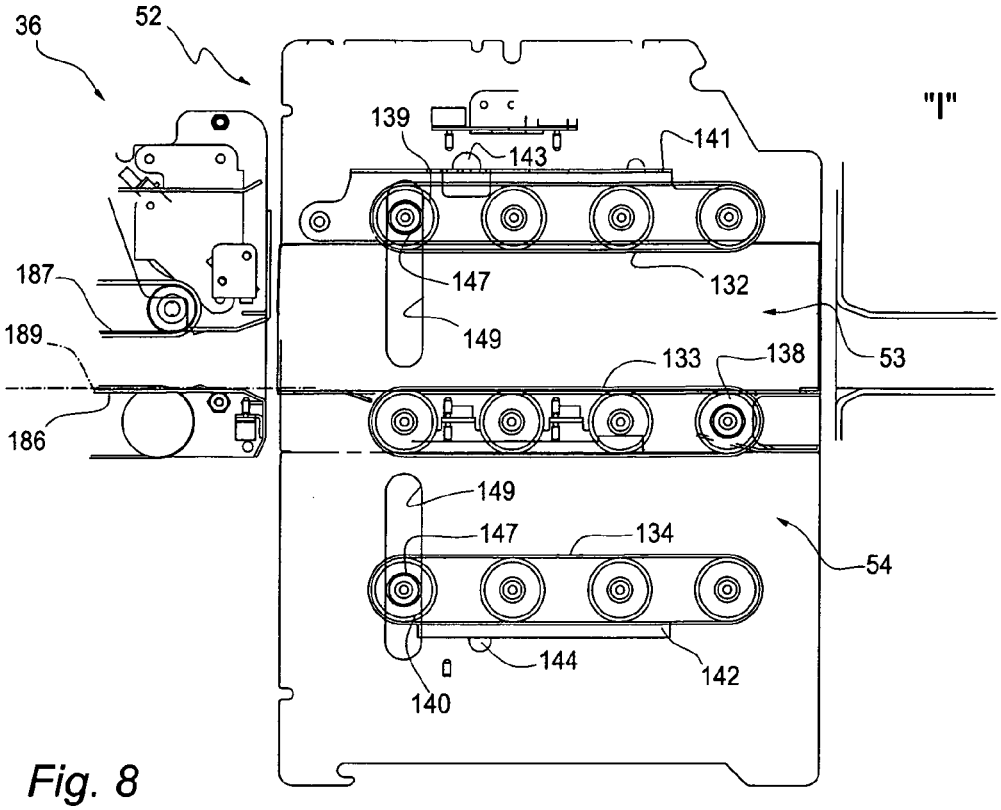
FIG. 8 represents a sectioned side view of the device of FIG. 7.
Figure 8A:
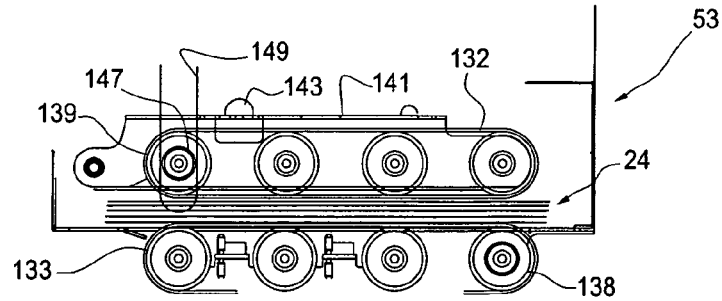
FIGS. 8*a* and 8*b* show two partial views of the device represented in FIG. 8 in different working conditions.
Figure 8B:
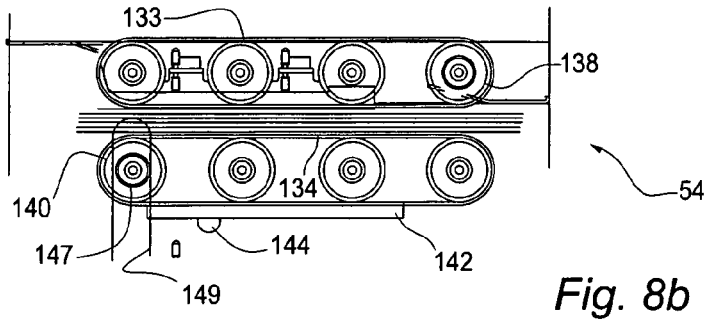
Figure 9:
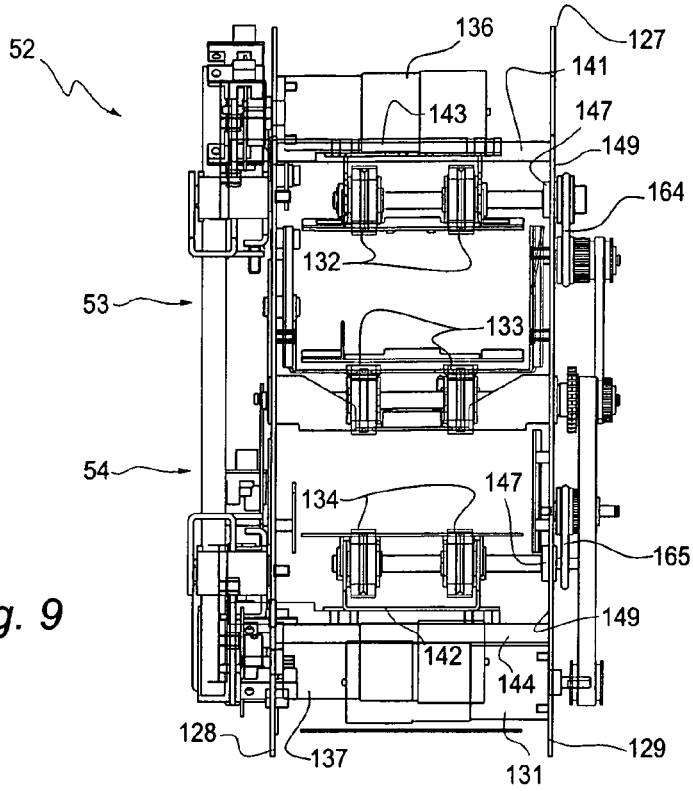
FIG. 9 represents a front view of the device shown in FIG. 7.
Figure 10:
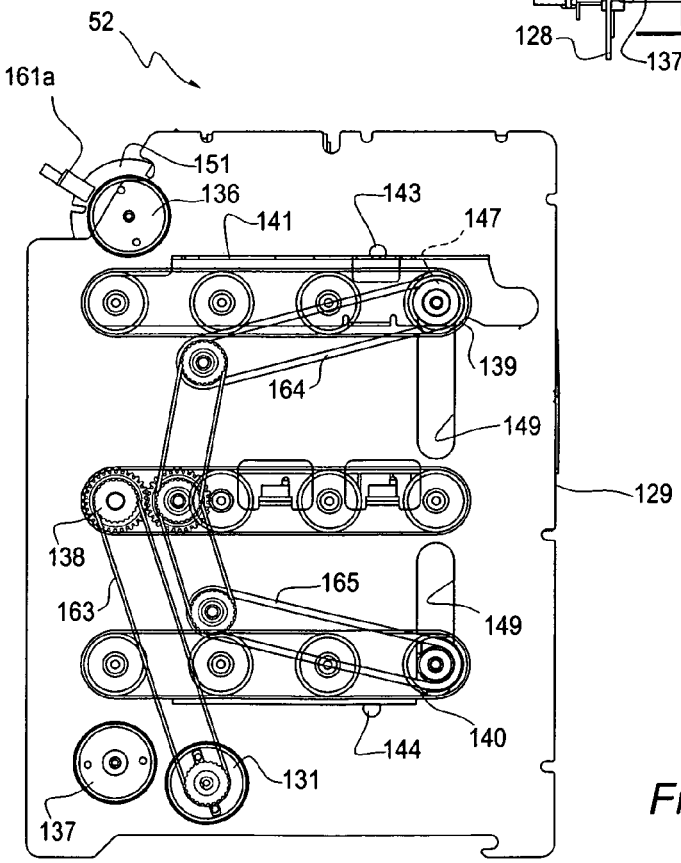
FIG. 10 is a side view of the device of FIG. 7, opposite to the view of FIG. 8.
Figure 13:
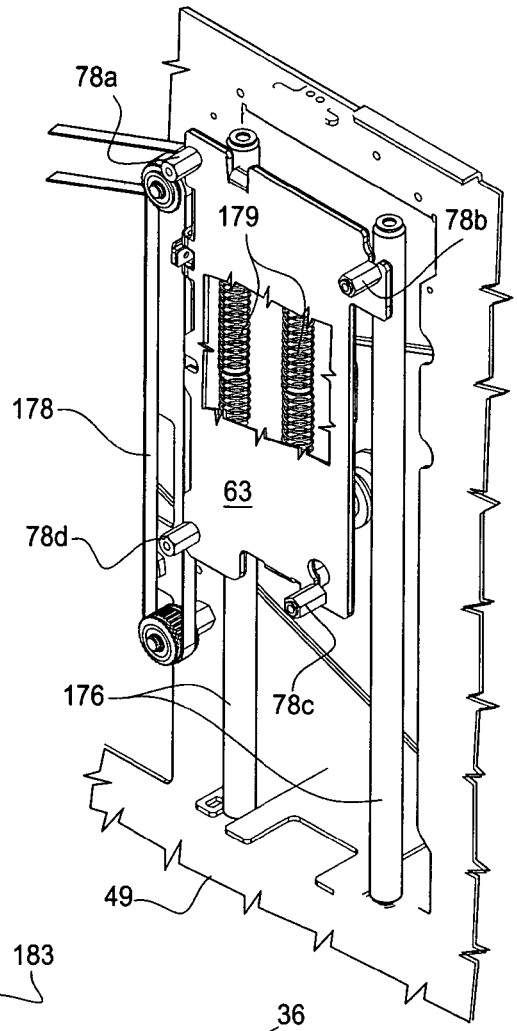
FIG. 13 represents a partial perspective view of a mechanism associated to the device shown in FIG. 7.
Figure 14:
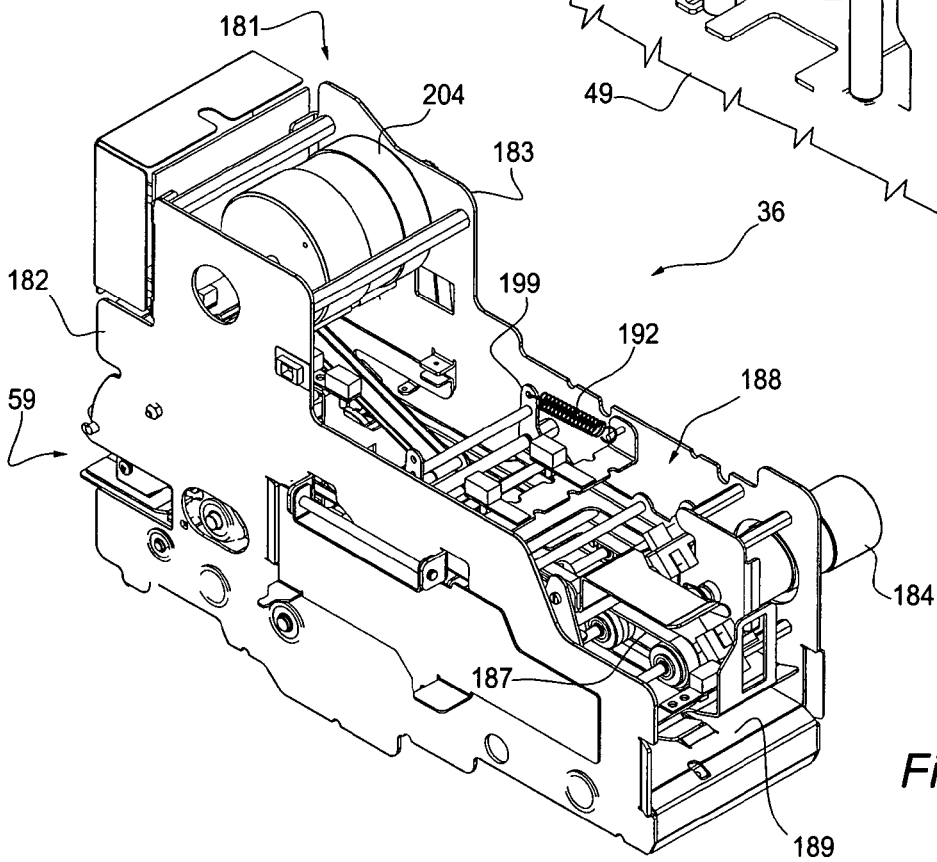
FIG. 14 represents, in enlarged scale, a perspective view of a further device of the equipment represented in FIG. 4.
Figure 15:
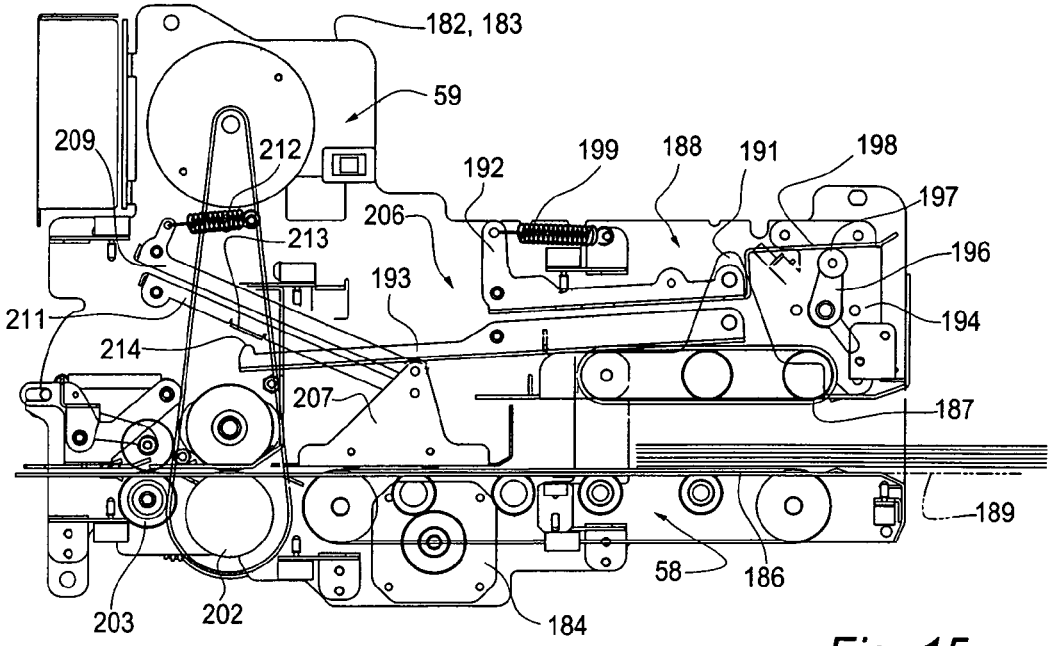
FIG. 15 shows a sectioned side view of the device of FIG. 14.
Figure 16A:
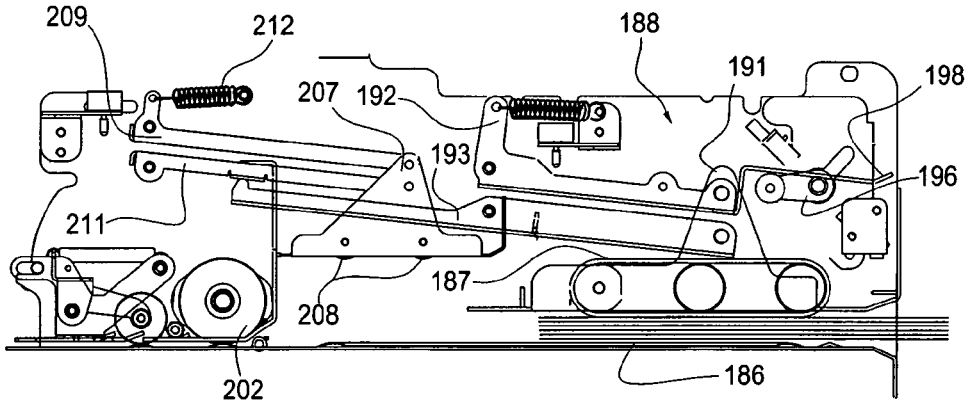
FIGS. 16*a* and 16*b* represent details of the device of FIG. 14 in different working configurations.
Figure 16B:
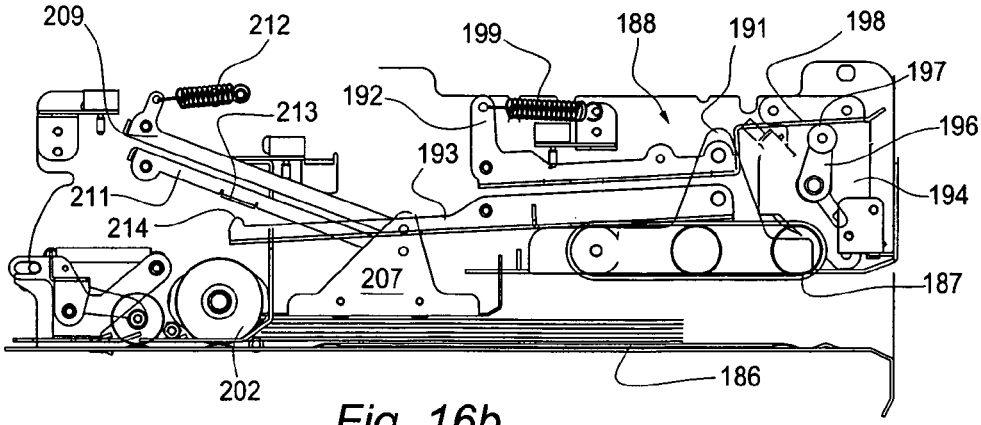
Figure 17A:
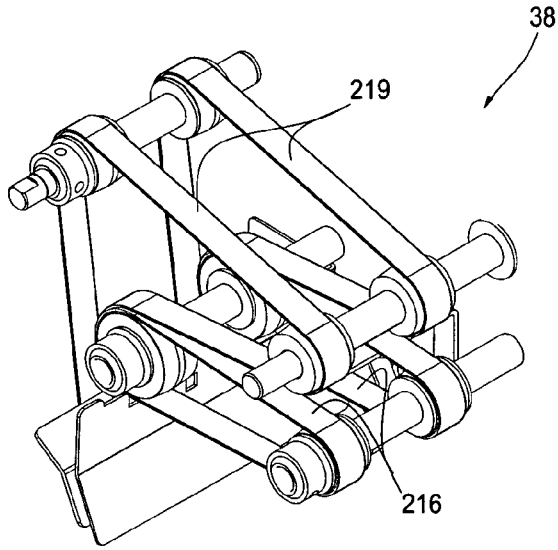
FIGS. 17*a* and 17*b* show, in enlarged scale, partial perspective views of two sections of a mechanism of the equipment represented in FIG. 4.
Figure 17B:
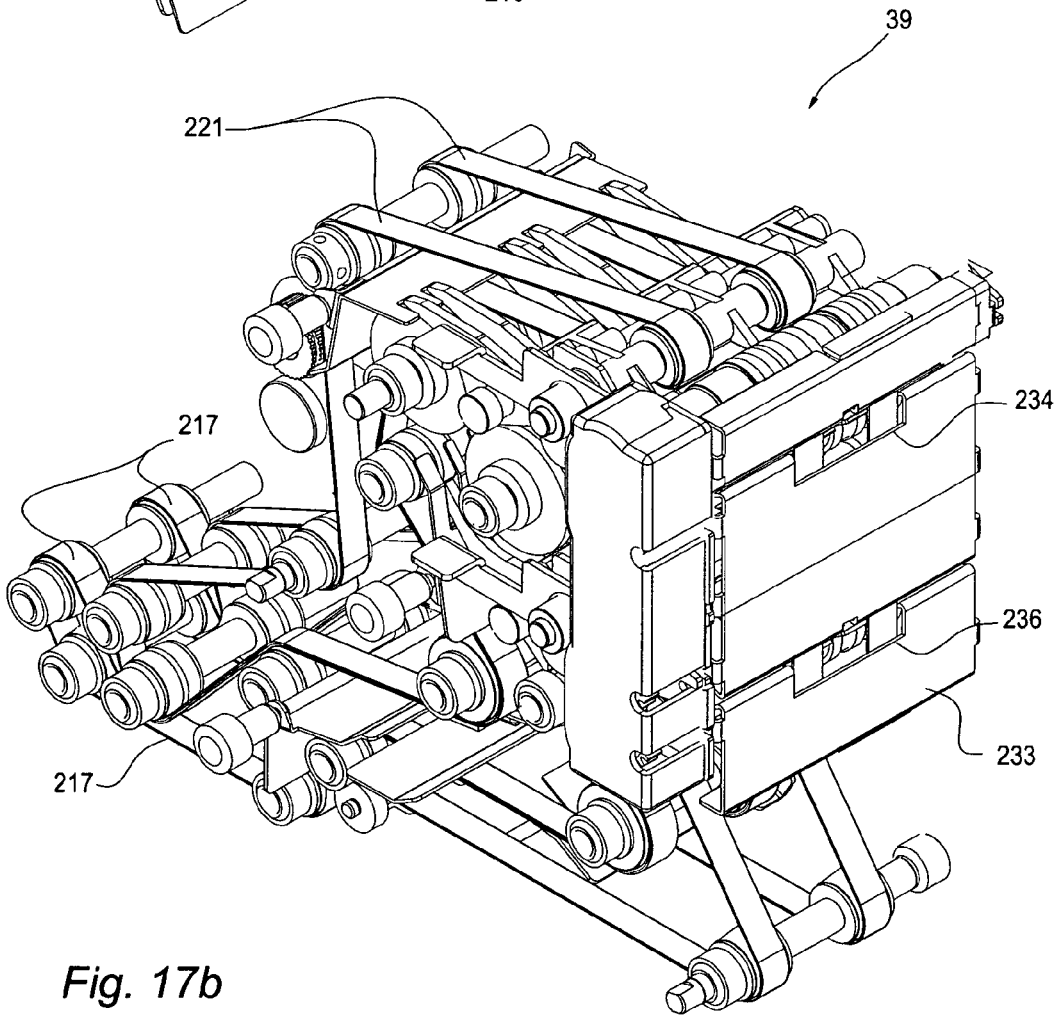

The box assembly 52 is mounted on a carriage 63 (FIGS. 4 and 13) adjacent to the side plate 49 of the frame 47 and it is operatively connected to a vertical shifting mechanism 64. The mechanism 64 is provided for moving the assembly 52, as an elevator, among three positions or levels, namely a reference position "I", a lowest position "II" and a highest position "III".

Figure 11:
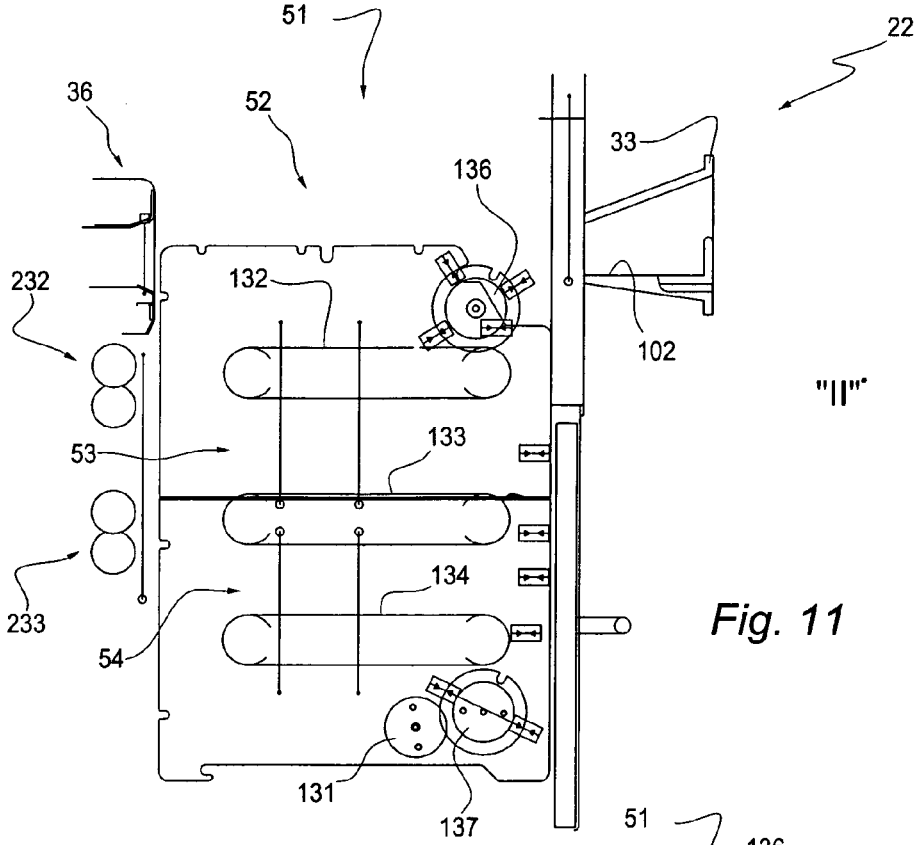
FIG. 11 represents a side schematic view of the device of FIG. 7 in a particular working configuration.
Figure 12:
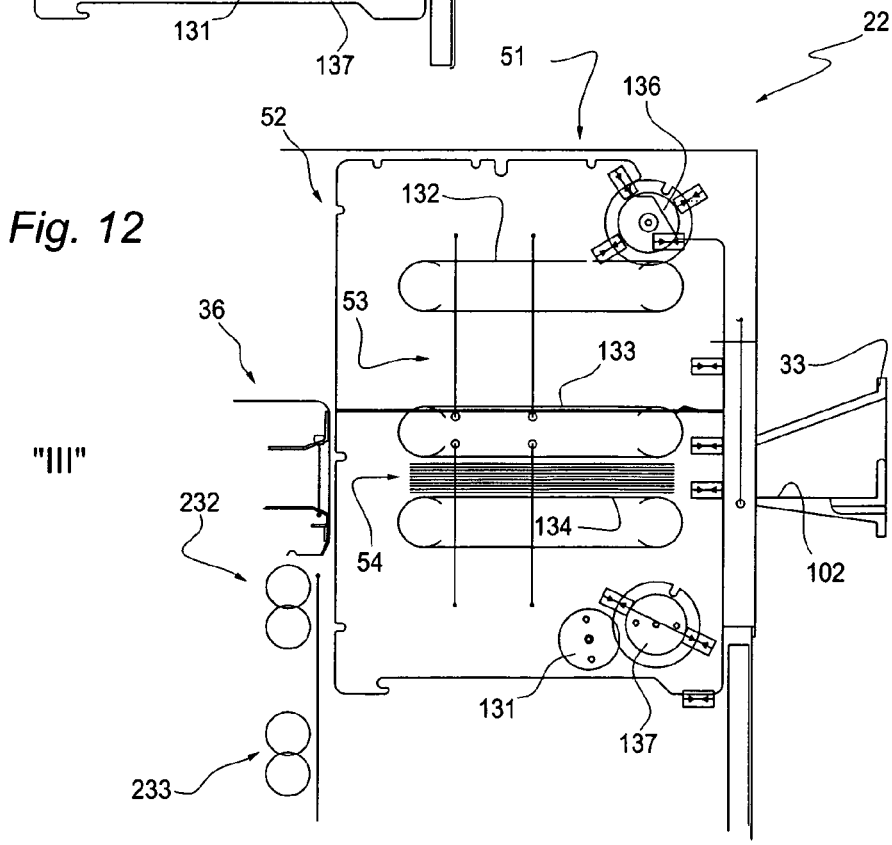
FIG. 12 shows the view of FIG. 11 in another working configuration.

The reference position "I" (FIGS. 2 and 8) of the assembly 52 is functional to the insertion of the stack 24 in the transaction port 33 and to a possible return of the stack to the customer. The lowest position "II" (FIG. 11) relates to particular steps of the procedure of deposit and the highest position "III" (FIG. 12) is functional to the return of the discards to the customer.

According to the present banking needs, the validation device 37 supplies recognition codes associated with the validated banknotes, the constituting sheets to be re-handled, and the banknotes recognized as false. The constitution of the device 37 relates to problems, different from those of the present invention and it is not described herein.

The store-safe 26 (FIG. 1) can comprise an input section 65, two deposit drawers 66*a* and 66*b*, a drawer of retract 67, a drawer of false 68 and suitable diverters. The input section 65 is arranged directly below the output opening 44 and the diverters are servo-dependent on the codes of the validation device 37 to address for the storing the validated banknotes toward the deposit drawers 66*a* and 66*b* and, respectively, the other constituting sheets to the drawer of retract 67 for being manually re-handled or toward the drawer of false 68.

The section 39 of the transport mechanism is provided for moving the constituting sheets emerging from the device 37 (FIG. 2) along a common path 69 and from the path 69 along a path of deposit-capture 71 or, in alternative, toward a path 72 for the recognized banknotes or toward a path 73 for the constituting sheets not recognized and to be manually re-handled.

The path of deposit-capture 71 is directed toward the output opening 44 for transferring to and storing in the store-safe 26 the validated and accepted banknotes, the constituting sheets to be re-handled and the false banknotes. The path 72 for the recognized banknotes is directed toward the box 53, whereas the path 73 for the constituting sheets not recognized is directed toward the box 54 when the assembly 52 (FIG. 11) is at the lowest position "II."

The path 72 for the recognized banknotes and the path 73 for the constituting sheets not recognized have end portions, which define sections of output arranged at different heights underneath the section of input of the separating device 36 (FIG. 2) and in condition of substantial vertical coplanarity. At the position "II" of the box 52 (FIG. 11), the sections of output of the paths 72 and 73 result adjacent to the banknote box 53 and, respectively, to the discard box 54.

The box assembly 52 (FIG. 1), the separating device 36, the validation device 37 and the sections 38 and 39 of the transport mechanism include couples of photo-emitters and photo-sensors represented in schematic way by alphabetical letters, which detect the presence of the banknotes 24 at the input section and along particular portions of the various paths.

By way of example, a photoelectric couple "A" is arranged at the input section of the box assembly 52; two couples "B", "C" are provided for the box 53 and two couples "D" and "E" are provided for the box 54. The separating device 36 includes a couple "F" at the input section, a couple "G" at an intermediate section, and two couples "H" and "I", at the input and the output of the separating mechanism 59. The section 38 of the transport mechanism includes a photoelectric couple "L" at the input section and a couple "M" at its output.

The section 39 of the transport mechanism includes a photoelectric couple "N" at the input section and two couples "O" and "P" at two intermediate sections of the common path 69. Two photoelectric couples "Q", "R" are arranged at intermediate portions of the paths 72 and 73, whereas two couples "S" and "T" detect the passage of the banknotes through the output sections of the path 73 and, respectively, through the path 71 adjacent to the output opening 44.

The actions of the photoelectric couples "A", "B", . . . "T" with the devices 36 and 37 and the transport mechanism are rather evident and, for brevity, have been omitted herein.

To advantage, the separating device 36, the validation device 37 and the box assembly 52 constitute functional unities which may be easily removed from the side plate 49 or from the carriage 63 (FIG. 4) in connection with operations of maintenance or for substitutions. The unities are connected with the electronic processing unit 40 through cables and connectors not shown in the figures. Further, the components of the equipment 22 are easily accessible through the side of the containing structure 32 in the case of jamming and to free the banknotes from clogged mechanisms and devices.

In the described example, the separating device 36, the validation device 37 and the sections 38 and 39 of the transport mechanism are mounted on a plate 74 fixed not too far from the side plate 49 of the frame 47 and the vertical shifting mechanism 64 is mounted on the plate 49. The separating device 36 and the validation device 37 are fixed on the plate 74 by means of pivots 76*a*, 76*b*, 76*c* and 76*d* and, respectively, small-columns 77*a*, 77*b* and 77*c*.

The carriage 63 (FIG. 13) includes a suitably shaped plate and the box assembly 52 is mounted on this plate by means of shims 78*a*, 78*b*, 78*c* and 78*d*.

Operations of Deposit

Figure 3:
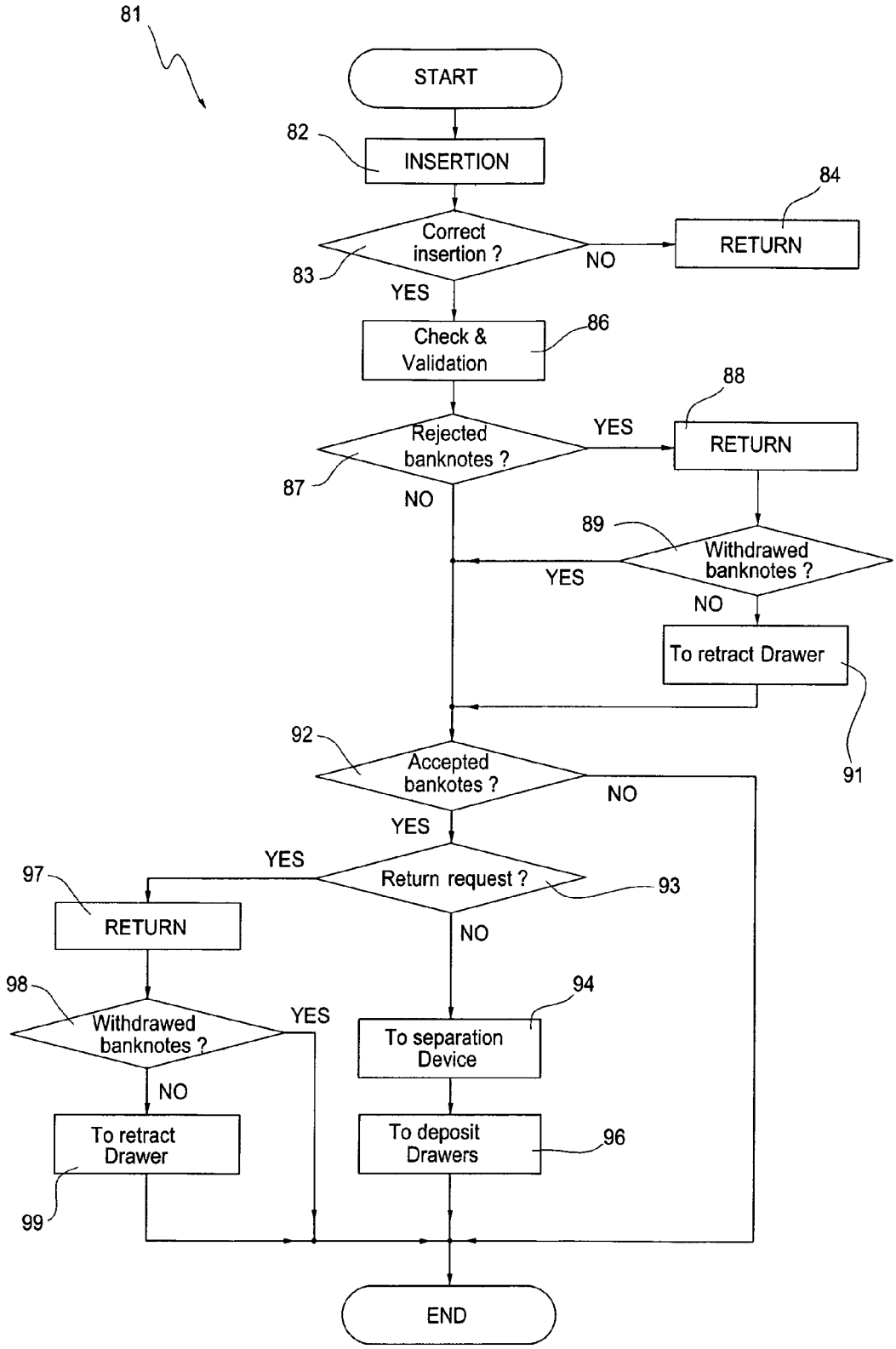
FIG. 3 is a flow chart showing the operation of the equipment for the deposit of banknotes according to the invention.

FIG. 3 shows a flow chart 81 including the principal steps which are followed by the equipment 22 for the execution of an operation of deposit of banknotes, according to an exemplary application program.

Figure 2:
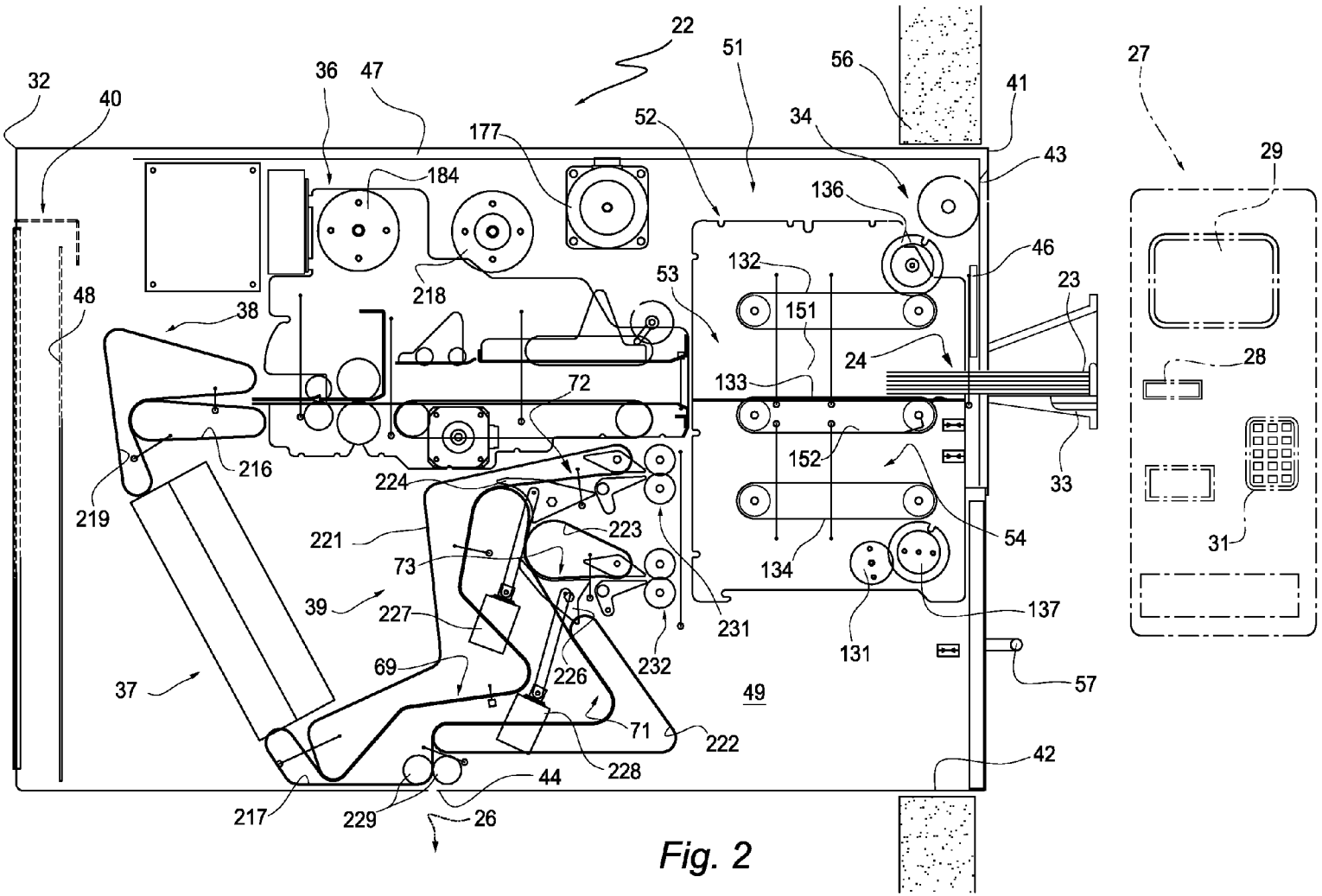
FIG. 2 shows, in enlarged scale, details of the equipment of FIG. 1.

In extreme synthesis, and with further reference to FIG. 2, the operation of deposit starts with the insertion of a magnetic badge in the reader 28. When the inserted card is recognized and the deposit is authorized by the system, the customer can start the procedure of deposit through the keyboard 31 and on instructions displayed on the screen 29.

In condition of rest, the shutter door 46 is closed and the assembly 52 is at the reference position "I" with the banknote storage box 53 adjacent to the transaction port 33, whereas on activation of the equipment 22 the shutter door 46 opens.

In an insertion step 82, the customer inserts the stack 24 of banknotes to be deposited in the transaction port 33 with partial projection and lodging of the stack in the storage box 53. The detection of banknotes by the photoelectric couple "A" in the box 53 causes the actuation of the control device 34. Thus the shutter door 46 will go down in contact with the upper surface of the stack 24 for the control of the thickness and a following re-opening.

If, in a checking step 83, the controlled thickness of the stack 24 is over the permissible limit, the process of deposit will be interrupted in a step of return 84 for allowing the customer to remove the stack 24 from the port 33.

If the check of the block 83 is positive, the holding mechanism 61, the moving mechanism 60 of the assembly 52 and the servomechanism for the door 46 are actuated in sequence. The stack 24 will be completely transferred to the storage box 53 and the door 46 will go completely down and locked.

Thereafter, the stack 24 is transferred to the separating device 36, and the vertical shifting mechanism 64 is activated for positioning the box assembly 52 at the position "II". The banknote box 53 is now arranged in front of the section of output of the path 72 for the recognized banknotes, whilst the discard box 54 is in front of the section of output of the path 73 for the constituting sheets not recognized.

In a checking and validation step 86, the components of the stack 24 are separated and the single sheets pass one after the other in front of the validation device 37. Then, the section 39 of the transport mechanism drags the constituting sheets along the common path 69 and along the paths 71 or 72 or 73 in response to the recognition codes of the sheets.

According to specific banking requests, the false banknotes are directly addressed along the path 71 and, through the output opening 44, captured in the drawer of false 68 of the store-safe 26.

The validated banknotes of the path 72 are piled in the storage box 53 to form a banknote sub-stack 50. The constituting sheets not recognized, as generic sheets or, typically, worn-out banknotes are addressed along the path 71 and are piled in the storage box 54 to form a discard sub-stack 55.

A checking step 87 examines the presence of non-recognized constituting sheets in the discard box 54. If positive, the processing unit 40 determines a return step 88 in which the box assembly 52 is positioned at the highest position "III", the shutter door 46 opens and the discard sub-stack 55 is moved into the transaction port 33 to allow the customer the withdrawal of the sub-stack 55.

If the customer does not take up the discards, check 89, after a period of pre-defined delay, the discard sub-stack 55 is moved into the devices 36, and 37, in a step of capture 91, and the transport mechanism finally deposits the constituting sheets in the drawer of retract 67.

Now, the electronic unit 40 proceeds to process the validated banknotes. In a decision box 92 there is verified if the storage box 53 contains validated banknotes and, if there are no banknotes, the transaction is completed.

In the case of presence of banknotes, checking step 93, the customer is allowed to interrupt the procedure of deposit.

If the customer accepts to proceed any further, at closed door 46, the mechanism 64 positions again the box assembly 52 at the position "I" in a step 94, whereas the moving mechanism 60 drags the banknote sub-stack 50 into the device 36 for another separating operation. In a final step 96, the banknotes are validated and the respective values are accounted and accredited. Then, the transport mechanism drags the banknotes along the path 71 and, through the output opening 44, to the store- safe 26 for the storage in the drawer 66*a* or 66*b*, whereby completing the transaction.

If, on the contrary, the customer decided to interrupt the procedure of deposit, a return step 97 is activated in which the assembly 52 is positioned at the reference position "I". The sub-stack 50 is moved into the transaction port 33 and the door 46 is opened for the withdrawal of the validated banknotes.

In a decision box 98 there is checked the withdrawal of the banknotes: in the positive, the transaction is completed. If, on the contrary, the customer does not takes up the banknotes, after a pre-defined period of delay, the sub-stack 50 is moved into the devices 36 and 37, in a step of capture 99, and the transport mechanism stores the banknotes in the drawer of retract 67.

The equipment 22 allows the execution of operation of deposit different from the ones above described. In fact, the various devices and the component mechanisms can follow different sequences and programming, according to rules or specific needs of the management entity. This is particularly true for what it concerns the procedures of return and the processing of the discards.

Sensing Device and Door Actuating Servomechanism

The thickness control device 34 (FIGS. 4, 5, 6*a* and 6*b*) and the door actuating servomechanism include, as common components, a micro-motor 101, a transmission assembly between the micro-motor 101 and the door 46 and a sensing group, including the door 46, used as sensing element for recognizing a pre-defined thickness of the stack 24 with respect to a reference plane 102.

In the transaction port 33, the reference plane 102 constitutes a surface of support for the stack 24 to be deposited and the panel 43 defines a window 103 of passage for the banknotes. This windows is delimited in the lower part by the reference plane 102.

The shutter door 46 is connected slidably and in contact with the panel 43, for closing and opening the window 103. In the closed position, the door 46 is in contact with the reference plane 102, can be locked in this position and, preliminarily to the opening, can be released by the servomechanism.

The shutter door 46 is obtained from a shaped steel plate 104. This plate includes a side with two vertical slots 106*l* and 106*h* and a refolded lower edge. The slots 106*l* and 106*h* are lined up and arranged at different heights, whilst the lower edge is provided for contacting the reference plane 102.

A guide side of the plate 104, opposite to the slotted side, is slidably contrasted by an iron member 107, and the slots 106*l* and 106*h* are slidably engaged by pivots 108*l* and 108*h* provided of contrast head. The iron member 107 and the pivots 108*l* and 108*h* are firmly fixed rear to the panel 43, and the whole is sized to withstand possible burgling actions on the shutter door 46.

The micro-motor 101 is mounted above the window 103 through a bracket 109; the transmission assembly comprises a disk 111 keyed on the output shaft of the micro-motor 101 with function of crank, a control pin 112 and a bar 113 with function of connecting rod. The bar 113 includes a slot 114 in which the pivot 112 is slidably engaged and is fulcrum-mounted on a lug of the plate 104 adjacent to the upper slot 106*h*.

The above described kinematic mechanism is of lost motion type, and a spring 116 operative on a lug of the plate 104 normally pushes downward the door 46. In condition of closed door (FIG. 6*b*), the control pin 112 is low adjacent to the upper portion of the slot 114 and, in absence of any lock, the door 46 may be easily lifted against the action of the spring 116 through the stroke allowed by the slot 114. In condition of open door (FIGS. 5 and 6*a*), the control pin 112 is high, engaged with the upper portion of the slot 114.

The sensing group of the control device 34 includes three photoelectric couples 117*a*, 117*b* and 117*c* and two sensing lugs 118*a* and 118*b*. The lugs 118*a* and 118*b* are parts of the plate 104 close to the slots 106. On turn, the photoelectric couples cooperate with the lugs to supply information regarding the lowest position of the door 46, of contrast with plane 102, the highest position, of opening, and the intermediate position, of reference.

The photoelectric couples 117*a* and 117*b* are adapted to cooperate with the lug 118*a* in association with the closing and the opening of the door, whereas the photoelectric couple 117*c* can cooperate with the lug 118*b* in relation to the thickness control of the stack.

An arrest tooth 119 (FIGS. 5, 6*a* and 6*b*) and a hook 121 are provided for the function of locking of the door 46. The tooth 119 is fixed on the plate 104, close to the higher slot 106*h*. The hook 121 it is fulcrum-mounted as a bridge on a pivot of the bracket 109 and is provided of an upper inclined edge.

The hook 121 defines a condition of lock and a condition of release of the door 26 and is urged toward the condition of lock by a spring 122. When the door 46 is depressed and is locked, the hook 121 engages the tooth 119 whilst, in the condition of release, the tooth is disengaged.

For the function of releasing, a releasing pin 123 actuatable by the micro-motor 101 and a lug 124 of the hook 121 are provided. The releasing pin 123 is keyed on the disk 111 on opposed sides beside the pivot 112, whilst the lug 124 is adapted to cooperate with the pivot 112 to set the hook 121 in the condition of release, in a pre-defined position of the disk 111.

When the shutter door 46 is closed, in contact with the plate 102, the arrest tooth 119 is engaged by the hook 121, in a condition of lock, and prevents any attempt of lifting of the door.

In a cycle of opening of the door 46, the micro-motor 101 (FIG. 6*b*) initially causes the shifting of the hook 121 in the condition of release through the action of the releasing pin 123 on the lug 124. The arrest tooth 119 is released and the door can lift for the action of the spring 116, following the movement of the pivot 112 with the lower portion of the slot 114. The complete opening of the door is recognized by the obscuring of the sensor in the couple 117*b* by the lug 118*a*, with a consequent arrest of the micro-motor 101. When the door is opened, the tooth 119 is above the hook 121 and does not cause any obstacle to lowering movements less than the one of contact with the plane 102.

In a cycle of closing and a little before the contact of the door with the plane 102, the arrest tooth 119 moves the hook 121 toward the condition of release by means of the inclined edge and against the action of the spring 122. The movement proceeds until the door 46 goes in contact with the plane 102 carrying the tooth 119 underneath the hook 121, and allowing the spring 122 to sharply move the hook 121 to the condition of lock. The complete closing of the door 46 is recognized by the obscuring of the sensor of the couple 117*a* by the lug 118*a*.

The spring shifting of the door 46 prevents possible injuries, in the case a customer left the fingers in the transaction port 33 during the closing of the door. In these conditions the hook 121 does not interfere with the door 46, whereas the control through the spring 116 allows the lifting of the door and the easy releasing of the fingers against the light action of the spring.

The reference position of the door 46 is relative to a predetermined height of its lower edge from the reference plane 102. This height corresponds to a thickness "S max" of the stack 24 to be deposited, less then the height of the window 103, for surely enabling the handling of the stack and its possible return in a reliable way. As an example, the thickness "S max" allows the deposit of one hundred banknotes, also under conditions of relative worn-out thereof.

As for the operation of the device 34, the checking step 83 (see FIG. 3) provides a cycle of closing and reopening of the door 46 after the opening of the transaction port 33 and the insertion of the stack 24. In the case the door is arrested by the stack 24 at a height greater of "S max", the sensor of the photoelectric couple 117*c* is not darkened by the lug 118*b* and the electronic unit 40 interrupts the procedure of deposit at the end of the check, and displays in the screen an error of insertion for the excess of banknotes.

If, on the contrary, the door 46 goes down underneath the height "S max" for a regular thickness of the stack, the lug 118*b* obscures the sensor of the photoelectric couple 117*c* during the descent of the door 46. At the end of the check, the deposit proceeds in rapids sequence, as previously described, with holding of the stack 24 by the mechanism 61 (FIG. 8), its dragging and the actuation of the micro-motor 101 for the closing and the locking of the door 46.

Box Assembly and Mechanism of Lifting

The box assembly 52 (FIGS. 7, 8, 9 and 10) comprises a frame 127 of substantially parallelepiped shape, vertically extended, having two sides 128 and 129. The respective moving mechanism 60 includes a motor 131 and three couples of endless conveyer belts 132, 133 and 134.

The belts 132, 133 and 134 are horizontally extended and the upper and lower branches have a useful length larger than the length of the longest acceptable banknotes. The upper and lower branches of each couple of belts are substantially coplanar and are at such a distance suitable for cooperating with central areas of all the typologies of the banknotes of the stack 24, according to a known technique.

The couples of conveyer belts 132 and 134 are arranged on an upper surface in the banknote box 53 and, respectively, on a lower surface in the discard box 54: the lower branches of the couple of belts 132 are arranged above the upper branches of the couple 133 and the upper branches of the couple 134 are below the lower branches of the couple of belts 133.

The holding mechanisms 61 and 62 are provided to move up and down the couples of belts 132 and 134 relatively to the belts 133, by varying the distance of the lower branches of the belts 132 with respect to the upper branches of the belts 133 and the distance of the upper branches of the belts 134 with respect to the lower branches of the belts 133.

According to the invention, the holding mechanism 61 defines three different configurations. The first configuration, of medium distance between the belts 132 and 133 is associated to the reception of the stack 24 through the transaction port 33, jointly to the position "II" of the assembly 52. The space between the belts left to the stack is a little larger of "S max", for an optimal insertion of the stack. Further, there is prevented that the banknotes 23 on top of the stack can slip and get jammed in the kinematic mechanisms of the banknote box 53.

The second configuration, of minimum distance between the belts 132 and 133, is associated to the holding of the stack 24 or the sub-stack 50 for the integral shifting of the respective constituting sheets by means of the upper and lower belts.

The third configuration, of maximum distance between the belts 132 and 133 is associated to the reception of the validated banknotes jointly with in the position "II" of the assembly 52. The space for the reception of the banknotes is at a maximum for an optimal formation of the banknote sub-stack 50.

The couple of endless belts 133 is common to the storage boxes 53 and 54 and is in engagement with respective rollers. The rollers are supported in the rotation in a central area of the frame 127 and include a motor roller 138.

The couples of endless belts 132 and 134 are in engagement with respective guide rollers including motor rollers 139 and 140. The rollers in engagement with the belts 132 and 134 are supported in the rotation, through intermediate elements, by platforms 141 and 142 provided of transversal axes 143 and 144 and shiftable by the holding mechanisms 61 and 62.

The platforms 141 and 142 have possibility of vertical movement between the sides 128 and 129 of the frame 127. To this end the axes 143 and 144 are keyed, at an end, on respective slide members 146 and the motor rollers 139 and 140 carry respective guide rollers 147. The slide member 146 are slidable on a guide iron member 148 mounted vertically on the side 128, whilst the two rollers 147 are slidable on two vertical slots 149 of the side 129, lined up one another.

The holding mechanisms 61 and 62 include each one a cam mechanism connected with the motor 136, 137, an elastic joint member interconnected between the cam mechanism and the shafts 143, 144 and sensor elements to define different configurations of the cam mechanism.

For the holding mechanism 61, the cam mechanism provides three configurations associated with the above described configurations of the belts 132 and 133.

For the mechanism 62 two configurations are provided. A first configuration is associated to a maximum distance between the belts for the reception of the constituting sheets not recognized and the formation of the discard sub-stack 55 in the position "II" of the assembly 52. A second configuration, of holding for the sub-stack, is associated to the shifting of the sub-stack is 55 by means of the upper belts toward the transaction port 33.

The cam mechanisms of the mechanisms 61 and 62 include respective disks 151 and 152 with a control pin 153, cam follower levers 154 and 155, each one with a slot 156 and an arm 157, and fork levers 158 and 159. The disks 151 and 152 are connected in the rotation with the motor 136, 137 and have function of crank, whereas the fork levers 158 and 159 are connected with the shafts 143 and 144 of the platforms 141 and 142.

The slots 156 of the levers 154 and 155 are in engagement with the control pins 153 of the disks 151 and 152 and the arms 157 are connected with the fork levers 158 and 159 through elastic joints having respective springs 160.

The sensor elements include three photoelectric couples 161*a*, 161*b* and 161*c* which detect three angular positions of the disk 151, and two photoelectric couples 162*a* and 162*b* which detect two angular positions of the disk 152.

The positions detected by the photoelectric couples 161*a*, 161*b* and 161*c* respectively correspond to the distances, medium, maximum and of holding of the belts 132 with respect to the belts 133. In turn, the positions detected by the couples 162*a* and 162*b* correspond to the maximum distance and the distance of holding of the belts 134 with respect to the belts 133.

The roller 138 is put in rotation by the motor 131 through a transmission belt 163 and the rollers 139 and 140 are put in synchronous rotation with the roller 138 through two kinematic chains including toothed wheels, toothed belts and two flexible belts 164 and 165. The flexible belts allow the transmission of the motion for the different positions of the platforms 141 and 142.

The senses of rotation of the motor rollers 138, 139 and 140 are such that the direction of motion of the lower branches of the couple 132 is consistent with the one of the upper branches of the couple 133 and the direction of motion of the upper branches of the couple 134 is consistent with the one of the lower branches of the couple 133.

In a rest condition of the holding mechanisms 61 and 62, the couple of belts 132 and 134 are spaced apart from the couple of belts 133. The spaces left in the boxes 53 and 54 are sufficient for free movements of a stack 24 or a banknote sub-stack 50 supported on the belts 133 and a discard sub-stack 55 supported on the belts 134.

In the working conditions, the couple of belts 132 or 134 is urged against the couple of belts 133 and holds the stack 24 or the sub-stack sandwiched between the couples of belts for the action of the spring 160. Thus, the couples of belts 132 and 133 or 133 and 134 operate, in coordinated and synchronous way, on the overlapped constituting sheets, ensuring an integral movement of the stacks 24 or the sub-stacks 50 and 55.

The shifting mechanism 64 of the box assembly 52 (FIGS. 2, 4 and 13) comprises a couple of vertical guides 176 for the carriage 63, a motor 177 and a toothed belt 178. The belt 178 extends vertically trough the whole stroke of the carriage 63 and is connected in the rotation with the motor 177 through a toothed transmission belt. The carriage 63 is fixed on a branch of the belt 178 and is connected to a couple of springs 179, of compensation for the weight of the box assembly 52.

In the position "I" of the box assembly 52, the banknote box 53 is adjacent to the transaction port 33 and, at the moment of insertion, a stack 24 arranged on the reference plane 102 of the transaction port partially bears on the couple of belts 132. In these conditions, the holding mechanism 61 can move down the couple of upper belts 132 for holding the stack between the two couples of belts, whereas the moving mechanism can transfer the whole stack 24 on the separating device 36.

In the position "II", the storage box 53 is adjacent to the end portion of the path 72 to receive the recognized banknotes. The storage box 54 is adjacent to the end portion of the path 73 to receive the constituting sheets not recognized, whilst the holding mechanisms 61 and 62 hold the belts 132 and 134 spaced apart from the couple of belts 133.

During the checking and validation step 86 (See FIG. 3), the section 39 of the transport mechanism drags, at high velocity, the banknotes to the storage box 53 and the constituting sheets not recognized to the storage box 54, and form the banknote sub-stack 50 on the belts 133 and the discard sub-stack 55 on the belts 134.

When the various photoelectric couples detect that all the constituting sheets have been separated, the electronic unity 40 actuates the holding mechanism 62 of the box 54, lifting the belts 134 so as to stop the discard sub-stack 55 against the belts 133. Then, the unity 40 actuates the mechanism 64, moving upwardly the assembly 52 up to the position "III."

In the position "III", the discard box 54 is adjacent to the transaction port 33, with the lower branch of the belts 132 and the upper portion of the discard sub-stack a little below the top edge of the window 103 and the higher branch of the belts 134 a little above the surface 102. On the contrary, the banknote box 53 is above the window 103.

During the return step 88 (see FIG. 3), the unity 40 actuates in sequence the door servomechanism for its opening and the moving mechanism 60 of the assembly 52 and the holding mechanism 62 for the withdrawal of the belts 134. The discard sub-stack 55 can be moved on the reference plane 102 for the return, whilst the banknote sub-stack 50 of the box 53 is higher than the window 103, arrested against a wall of arrest of the front 41 during the movement of the belts 133.

If the customer does not withdraw in time the discard sub-stack 55, in the step 91 (See FIG. 3), the electronic unity 40 actuates in sequence the holding mechanism 62 for the condition of holding of the belts 134 and the moving mechanism 60 to drag the sub-stack in the device 36 and the door servomechanism for its closing, starting the capture in the drawer of retract. Also in this case, the banknote sub-stack 50 of the box 53 is higher than the window 103, arrested against the wall of arrest of the device 36.

Device of Separation

The separating device 36 (FIGS. 2 and 14) comprises a horizontal extended frame 181 with two sides 182 and 183. The stack moving mechanism 58 includes a motor 184, two endless conveyer belts 186 and 187 and a contrast mechanism 188.

The conveyer belts 186 and 187 are set at different heights according to an axial surface and have horizontal extension. The belts 186 and 187 are in engagement with respective guide rollers and a motor roller and are arranged in an intermediate area of the frame 181 to centrally cooperate with the stack 24 or the sub-stacks 50 or 55 and according to the longitudinal axes.

The stack moving mechanism 58 defines a movement surface 189 of the stack 24 or the sub-stack 50, 55 substantially coplanar with the surface of the transaction port 33 and comprises an input section adjacent to the box assembly 52, an intermediate section and an output section.

The separation mechanism 59 is adjacent to the section of output and is adapted to separate the constituting sheets of a stack 24 or the sub-stack 50, 55 positioned between the sections intermediate and of output of the surface 189.

The transport belt 186 is mounted in a lower portion of the frame 181 and its upper branch is on the movement surface 189. The belt 187 is mounted on a support structure 191 arranged longitudinally above of the surface 189, with the lower branch arranged directly above the upper branch of the belt 186. The belt 186 has a useful length greater of the longest acceptable banknotes and extends through a main portion of the frame 181 beginning from the input section. The conveyer belt 187 has a smaller length and extends between the input section and the intermediate section of the frame 181.

The contrast mechanism 188 is adapted to move in height the structure 191, varying the distance of the lower branch of the conveyer belt 187 with respect to the upper branch of the belt 186. In a lifted position of the structure 191, a stack 24 or a sub-stack 50, 55 are free of movement on the surface 189. On the contrary, in a lowered holding position of the structure 191, the stack 24 or the sub-stack 50, 55 are opposed by the conveyer belts 186 and 187 for being moved integrally toward the separation mechanism 59.

The motor 184 is directly connected in the rotation with the motor roller of the conveyer belt 186. The motor roller of the conveyer belt 187 is connected in the rotation with the motor 184 through kinematic chain comprising an elastic belt for compensating the different heights of the parts, with synchronous and concurrent motion of the belts 186 and 187.

The support structure 191 is connected with the frame 181 through an articulated parallelogram including an upper lever 192 and a lower lever 193, both of rocker arm type. The contrast mechanism 188 includes an actuating motor 194 and a crank 196 connected in the rotation with the motor 194 and adapted to cooperate, through a roller 197, with a lug 198 of the lever 192. A spring 199, operative on the lever 192, pushes downward the structure 191 whilst, in the condition of rest, the crank 196 holds the structure 191 in the lifted position.

The separating mechanism 59 includes in the lower part a series of separating rollers 202, a series of counter-rollers 203, a separating motor 204 and a pressure assembly 206 for the stack 24 or the sub-stack 50, 55. The rollers 202 are coaxial each the other and are rotated by the motor 204 in the sense of separation. The counter-rollers 203 are also coaxial, interposed with interference between the rollers 202 and are rotated by the motor 204 in a sense opposite to the direction of separation to avoid any double feed of the banknotes and according to a well known technique.

The pressure assembly 206 (FIGS. 15, 16*a* and 16*b*) includes a sustaining structure 207 with a lower guiding plate and two pinch rollers 208 which longitudinally extends between the sections intermediate and of output of the movement surface 189. The guiding plate and the rollers 208 are arranged directly above the higher branch of the belt 186 and the sustaining structure 207 is connected with the frame 181 through an articulated parallelogram. This parallelogram comprises an upper lever 209 and a lower lever 211 and is urged downward by a spring 212 connected to the lever 209.

The assembly 206 is connected with the contrast mechanism 188 through a lug 213 of the lever 211 and an end 214 of the lever 193. The connection of the two levers 193 and 211 is such that to the lifted position and to the holding position of the belt 187 correspond a lowered position and, respectively, a lifted position of the structure 207.

Transport Mechanism

The sections 38 and 39 of the transport mechanism (FIGS. 2, 4, 15*a* and 15*b*) include two couples of endless transport belts 216 and 217 in which the belts are arranged side by side on guide rollers mounted on the plate 74.

According to a known technique, the banknotes 23 are held on the transport belts or followed in the movement by suitable counter-belts, also of endless type, urged against the transport belts and driven by other rollers mounted on the plate 74. Further, the banknotes are guided by guide tiles in the output areas or in the input sections of the various devices. The transport belts and the counter-belts are actuated in synchronism by a transport motor 218 mounted on the plate 74 and through belts not shown in the figures.

The section 38 (FIGS. 2 and 15*a*) of the transport mechanism includes one couple of counter-belts represented with 219. The section 39 (FIGS. 2 and 15*b*) includes a couple of counter-belts 221 for the definition of the common path 69 and the path of deposit-capture 71 and two couples of counter-belts 222 and 223 which respectively define the path 72 and the path 73.

For the deviations from the path of deposit-capture 71, the section 39 of the transport mechanism includes a diverter 224 and a diverter 226 actuated by respective electromagnets 227 and 228, in turn servo-dependent on the validation device 37. The diverter 224 moves the banknotes 23 of the common path 69 along the path 72 and the diverter 226 moves the discards of the path 71 along the path 73.

The movement of the banknotes and the discards in the output area and at the end portions of the paths 71, 72 and, respectively 73, is actuated by couples of groups of opposite rollers 229, 231 and 232 connected in the rotation with the motor 218. The couple of rollers 229 is arranged above the output opening 44 whilst the couples of rollers 231 and 232 are protected by a wall 233 and are arranged in front of respective windows 234 and 236, at different heights of the wall 23.

Naturally, the principle of the invention remaining the same, the embodiments and the details of construction can be widely varied with respect to what has been described and illustrated, by way of non-limitative example, without by this departing from the ambit of the present invention.

We claim:

1. An equipment for the automatic deposit of banknotes comprising a transaction port for receiving a stack of banknotes, a separating device for separating the constituting sheets of the stack, a validation device for discriminating the constituting sheets as recognized banknotes and as constituting sheets not recognized, a transport mechanism servo-dependent on the validation device to drag said constituting sheets along differentiated paths for the recognized banknotes and, respectively, for the constituting sheets not recognized, a box assembly including a frame, and a shifting mechanism for vertically moving, in the use, said frame among three different positions in a passage space between the transaction port and the separating device;

wherein said box assembly comprises upper endless conveyer belts, intermediate endless conveyer belts and lower endless conveyer belts supported by said frame and defining two storage boxes;

wherein said three positions are associated with predetermined conditions of communication of the storage boxes with the transaction port, the separating device and the transport mechanism to receive the stack, transfer the stack to the separating device, temporarily store, respectively, the recognized banknotes as a banknote sub-stack and the constituting sheets not recognized as a discard sub-stack and to return, by request, the discard sub-stack and the banknote sub-stack; and wherein the conveyer belts are provided for cooperating with the sheets constituting the stack or the sub-stacks, said upper belts and said lower belts being movably supported by said frame to be moved toward the intermediate belts and away from said intermediate belts, the stack and the banknote sub-stack being engageable between the upper belts and the intermediate belts, and the discard sub-stack being engageable between the intermediate belts and the lower belts;

said box assembly further comprising a first holding mechanism and a second holding mechanism supported by said frame and operatively connected, respectively, with the upper belts and the lower belts and actuatable for independently moving the upper belts toward the intermediate belts and the lower belts toward the intermediate belts to make integral in the movement the sheets constituting the stack or the sub-stacks of the two boxes with said conveyer belts, and to allow the shifting of said stack or said sub-stacks by said belts.

2. Equipment according to claim 1, wherein said transport mechanism includes a diverter member actuatable for dragging the constituting sheets emerging from the validation device to an output opening along a given path of deposit, said equipment being used in combination with a store-safe including a deposit drawer for storing the recognized banknotes, a drawer of retract for the constituting sheets not recognized and diverters, servo-dependent on the validation device, to address the validated banknotes emerging from said output opening toward the deposit drawers and, respectively, the other constituting sheets toward the drawer of retract.

3. Equipment according to claim 2, wherein said validation device is provided to identify false banknotes among the constituting sheets not recognized and wherein the store-safe of the combination further includes a drawer of false for the banknotes recognized as false, the diverters of the store-safe responding to said validation device to address the false banknotes emerging from said output opening toward said drawer of false.

4. Equipment according to claim 1, wherein the separating device includes lower separation conveyer belts, upper separation conveyer belts and a contrast mechanism operatively connected with the upper separation belts, one of said storage boxes defining a banknote box for receiving said stack or the banknote sub-stack;

wherein, the transaction port and an input section of the separating device are substantially at a same height and wherein, at a first position of said frame, the banknote box is in communication with the transaction port and the separating device with an upper branch of the intermediate belts at the same level of the transaction port and at a same level of said lower separation conveyer belts and, at a second position of the frame, said banknote box is in communication with the transport mechanism;

said banknote box being provided to receive said stack on the upper branch of the intermediate belts with a lower branch of the upper belts spaced apart from the upper branch of the intermediate belts and transfer said stack to said separating device, at the first position of the frame, with the lower branch of the upper belts engaged with the stack, and to receive the recognized banknotes on said upper branch of the intermediate belts and constitute the banknote sub-stack, at the second position of the frame, with the lower branch of the upper belts spaced apart from the upper branch of the intermediate belts; and wherein, at the first position, said banknote box is further provided to transfer the banknote sub-stack to the upper branch of said separating device for being engaged by said upper separation conveyer belts under the action of the contrast mechanism or, in alternative, to return said banknote sub stack to the transaction port.

5. Equipment according to claim 1, wherein the transaction port and the input section of the separating device are substantially at a same height, wherein at a first position of said frame, an upper branch of the intermediate belts is at the same level of the transaction port and an input section of the separating device to receive said stack and transfer it to the separating device; and wherein at the second position of the frame, one of the storage boxes is adjacent to a section of output of the path for the recognized banknotes for forming the banknote sub-stack on the upper branch of the intermediate belts, whilst another of the storage boxes is adjacent to a section of output of the path for the constituting sheets not recognized for forming the discard sub-stack on an upper branch of the lower belts; and at the third position, the other of the storage boxes is adjacent to the transaction port with the upper branch of the lower belts at the same level of the transaction port to return the constituting sheets not recognized of the discard sub-stack to said transaction port.

6. Equipment according to claim 1, wherein one of said storage boxes defines a discard box for receiving the constituting sheets not recognized and forming the discard sub-stack;

wherein, at a second position of the box assembly, the discard box is in communication with the transport mechanism for receiving the constituting sheets not recognized on the upper branch of the lower belts and forming the discard sub-stack with the upper branch of the lower belts spaced apart from the lower branch of the intermediate belts; and wherein, at a third position of the box assembly, the discard box is in communication with the transaction port and the separating device with the upper branch of the lower belts urging the discard sub-stack against the lower branch of the intermediate belts and said upper branch of the lower belts arranged at the same level of the transaction port to return the discard sub-stack to said transaction port or to transfer said discard sub-stack to the separating device.

7. Equipment according to claim 1, wherein said upper conveyer belts, said intermediate conveyer belts and said lower conveyer belts comprise couples of endless conveyer belts, wherein the belts of each couple of conveyer belts are placed side by side for cooperating with central areas of the sheets constituting the stack or the sub-stacks.

8. Equipment according to claim 1, wherein said box assembly further comprises a moving mechanism for actuating the upper belts, the intermediate belts and the lower belts, to determine a concurrent sense of motion between the lower branches of the upper belts and the higher branch of the intermediate belts and between the lower branch of the intermediate belts and the higher branch of the lower belts, and wherein said moving mechanism includes a motor mounted on said frame and transmission belts and pulleys operatively connecting said motor with said endless conveyer belts.

9. Equipment according to claim 1, further comprising, at said transaction port, a window of access toward the inside to receive said stack and a shutter door for said window movable along a movement surface adjacent to the window, a thickness control device having a sensor provided for bearing on a stack of the transaction port to detect a condition of pre-defined maximum thickness of said stack, and a moving mechanism for actuating said belts, said moving mechanism being servo-dependent on the sensing device to automatically introduce a stacks received in the transaction port and having thickness less than said maximum thickness.

10. Equipment according to claim 1, wherein the first holding mechanism defines three configurations including a first configuration, of medium distance between the belts, for receiving the stack from said transaction port, a second configuration for engaging the sheets constituting the stack or the banknote sub-stack between the upper belts and the lower belts and functional to the integral shift of said stack or sub-stack, and a third configuration, of larger distance between the belts, for the formation of said banknote sub-stack.

11. Equipment according to claim 1, wherein the box assembly further comprises two respective platforms for said upper belts ad said lower belts, wherein said platforms are vertically movable on said frame, and wherein the first holding mechanism and the second holding mechanism comprise each one a servo-motor, a cam mechanism actuated by said servo-motor and an elastic joint member interconnected between the cam mechanism and the respective platform.

12. Equipment according to claim 1, wherein the frame of said box assembly is mounted on a carriage slideable on vertical guides, and wherein the shifting mechanism comprises a motor, a vertically lengthened toothed belt connected to said carriage and actuated by said motor and spring means for compensating the weight of the box assembly.

13. An equipment for the automatic deposit of banknotes comprising a transaction port for receiving a stack of banknotes, a separating device for separating the constituting sheets of the stack, a validation device for discriminating the constituting sheets as recognized banknotes and as constituting sheets not recognized, a transport mechanism servo-dependent on the validation device to drag said constituting sheets along differentiated paths for the recognized banknotes and, respectively, for the constituting sheets not recognized, a box assembly with a frame, and a shifting mechanism for vertically moving, in the use, said frame among three different positions in a passage space between the transaction port by one side and the separating device and the transport mechanism by another side;

wherein the separating device has lower separation conveyer belts, upper separation conveyer belts and a contrast mechanism for moving the upper separation conveyer belts toward and away said lower separation conveyer belt, said lower separation conveyer belts being substantially at the same level of the transaction port, whilst the differentiated paths provide, below the lower separation conveyer belts, an upper output for the recognized banknotes and a lower output for the constituting sheets not recognized;

wherein said box assembly further comprises upper endless conveyer belts supported by an upper portion of the frame, intermediate endless conveyer belts fixedly supported by an intermediate portion of said frame, and lower endless conveyer belts supported by a lower portion of the frame; the upper belts and the intermediate belts defining a banknote box and the intermediate belts and the lower belts defining a discard box;

wherein, at a first position of the box assembly, the banknote box is in communication with the transaction port and the separating device with an upper branch of the intermediate belts substantially at the same level of the transaction port to receive the stack, and transfer the stack to the separating device; at a second position of the box assembly, said banknote box is in communication with the upper output of the differentiated paths to temporarily store the recognized banknotes as a banknote sub-stack, whilst the discard box is in communication with the lower output to temporarily store the constituting sheets not recognized as a discard sub-stack; and at a third position of the frame, the discard box is in communication with the transaction port and the separating device to return, by request, the discard sub-stack or transfer the discard sub-stack to the separating device;

said stack and the banknote sub-stack being engageable between the upper belts and the intermediate belts, and said discard sub-stack being engageable between the intermediate belts and the lower belts;

said box assembly further supporting a moving mechanism for the actuation of said belts, a first holding mechanism and a second holding mechanism operatively connected, respectively, with the upper belts and the lower belts and selectively actuatable to move the upper belts toward the intermediate belts and the lower belts toward the intermediate belts to make integral in the movement the sheets constituting the stack or the sub-stacks of the two boxes with said conveyer belts, and to allow said moving mechanism to shift said stack or said sub-stacks through said belts;

said banknote box being provided to receive said stack on the upper branch of the intermediate belts with a lower branch of the upper belts spaced apart from the upper branch of the intermediate belts and transfer said stack to the lower separation conveyer belt of the separating device at the first position with the lower branch of the upper belts engaged with the stack, and to receive the recognized banknotes on said upper branch of the intermediate belts and constitute the banknote sub-stack at the second position with the lower branch of the upper belts spaced apart from the upper branch of the intermediate belts.

14. Equipment according to claim 13, wherein said lower separation conveyer belts are provided to receive the discard stack at the third position of the box assembly, and wherein said contrast mechanism is actuatable to move the upper separation belts toward the lower separation belts to make integral in the movement the sheets constituting the stack or the sub-stacks with said separation conveyer belts, and to allow the shifting of said stack or said sub-stacks by said separation belts.

15. Equipment according to claim 13 further comprising, at said transaction port, a window of access toward the inside to receive said stack and a shutter door for said window movable along a movement surface adjacent to the window, a thickness control device having a sensor provided for bearing on a stack of the transaction port to detect a condition of pre-defined maximum thickness of said stack, and a moving mechanism for the automatic insertion of the stack received in the transaction port, said moving mechanism being servo-dependent on the sensing device to introduce stacks of thickness less than said maximum thickness.

16. Equipment according to claim 13, further comprising, at said transaction port, a window with a reference plane of access toward the inside to receive said stack, and a shutter door for said windows, wherein, at the first position of the box assembly, an upper branch of the intermediate belts is substantially coplanar with said reference plane and a lower branch of the upper belts is spaced apart from the upper branch of the intermediate belts to receive a portion of said stack across said window, and wherein, the respective holding mechanism is provided to move the upper belts toward the intermediate belts to make integral in the movement the sheets constituting the stack with said upper belts and said intermediate belts for following actuation of the moving mechanism for shifting said stack up to be completely received in the upper portion of the box assembly, and the shutter closing said window for the further process of the stack.

17. An equipment for the automatic deposit of banknotes comprising a transaction port for receiving a stack of banknotes, a separating device for separating the constituting sheets of the stack, a validation device for discriminating the constituting sheets as recognized banknotes and as constituting sheets not recognized, a transport mechanism servo-dependent on the validation device to drag said constituting sheets along differentiated paths for the recognized banknotes and, respectively, for the constituting sheets not recognized, a box assembly including a frame, and vertically moveable, in the use, among three different positions with respect to the transaction port;

wherein said frame supports upper endless conveyer belts, intermediate endless conveyer belts and lower endless conveyer belts defining an upper banknote box and a lower discard box;

wherein said three positions are associated with predetermined conditions of communication of the banknote box and the discard box with the transaction port, the separating device and the transport mechanism to receive the stack, transfer the stack to the separating device, temporarily store, respectively, the recognized banknotes as a banknote sub-stack and the constituting sheets not recognized as a discard sub-stack and to return, by request, the discard sub-stack and the banknote sub-stack;

wherein the conveyer belts are provided for cooperating with the sheets constituting the stack or the sub-stacks, wherein the upper belts are arranged in an upper portion of the box assembly, the intermediate belts are in an intermediate portion, and the lower belts are in a lower portion of the box assembly, wherein said upper belts and said lower belts are movably supported by said frame and a respective holding mechanism is provided for selectively moving the upper belts and the lower belts toward and away with respect to the intermediate belts, said stack and the banknote sub-stack being provided for engagement between the upper belts and the intermediate belts, and said discard sub-stack being provided for engagement between the intermediate belts and wherein a moving mechanism actuates said upper belts, said intermediate belts, and said lower belts for the shifting of the stack and sub-stack; said equipment further comprising, at said transaction port, a window with a shutter door and a reference plane of access toward the inside to receive said stack, wherein, at a first position of the box assembly, the banknote box is in communication with the transaction port and the separating device with an upper branch of the intermediate belts coplanar with said reference plane and a lower branch of the upper belts spaced apart from the upper branch of the intermediate belts to receive a portion of said stack across said window, and, at a second position of the box assembly, said banknote box is in communication with the transport mechanism; and wherein the respective holding mechanism is provided to move the upper belts toward the intermediate belts, at the first position of the box assembly, to make integral in the movement the sheets constituting the stack with said upper belts and said intermediate belts for following actuation of the moving mechanism with shifting of said stack up to be completely received in the banknote box, and the shutter closing said window for the further process of the stack of banknotes.

18. Equipment according to claim 17 wherein the respective holding mechanism defines a configurations of the upper belts, of medium distance from the intermediate belts, for receiving the stack from said transaction port, and another configuration, of larger distance from the intermediate belts, for the formation of said banknote sub-stack.

19. Equipment according to claim 17 further comprising a thickness control device having a sensing device provided for bearing on a stack of the transaction port to detect a condition of pre-defined maximum thickness of said stack; wherein said moving mechanism is servo-dependent on the sensing device for introducing stacks having a thickness less than said maximum thickness; and wherein said sensing device is operative jointly with the movement of said shutter door by said servo-mechanism.

20. Equipment according to claim 17, wherein, at the second position of the box assembly, the banknote box is adjacent to the section of output of the path for the recognized banknotes for forming the banknote sub-stack on the upper branch of the intermediate belts whilst the discard box is adjacent to the section of output of the path for the constituting sheets not recognized for forming the discard sub-stack on the upper branch of the lower belts; and, at the third position, the discard box is adjacent to the transaction port with the upper branch of the lower belts at the same level of the transaction port to return the constituting sheets not recognized of the discard sub-stack to said transaction port; said banknote box being further provided for transferring the banknote sub-stack to the separating device for a second separation operation at the first level of the box assembly.

* * * * *